US012466637B1

(12) United States Patent
Newlands

(10) Patent No.: US 12,466,637 B1
(45) Date of Patent: Nov. 11, 2025

(54) DISPENSING SYSTEM FOR HOLLOW ROUND PACKAGES

(71) Applicant: Paulo Roberto Jannotti Newlands, Rio de Janeiro (BR)

(72) Inventor: Paulo Roberto Jannotti Newlands, Rio de Janeiro (BR)

( * ) Notice: Subject to any disclaimer, the term of this patent is extended or adjusted under 35 U.S.C. 154(b) by 0 days.

(21) Appl. No.: 19/059,243

(22) Filed: Feb. 20, 2025

(51) Int. Cl.
*B65D 21/08* (2006.01)
*B65D 25/24* (2006.01)
*B65D 83/76* (2006.01)

(52) U.S. Cl.
CPC ..... *B65D 83/76* (2025.01); *B65D 25/24* (2013.01)

(58) Field of Classification Search
CPC ..... B65D 83/76; B65D 25/24
See application file for complete search history.

(56) References Cited

U.S. PATENT DOCUMENTS 982,661 A * 1/1911 Dickens ..... B65D 83/76 239/320
1,006,641 A * 10/1911 Fesler ..... B43K 7/02 401/175
1,067,596 A * 7/1913 Fesler ..... A46B 11/0027 401/175
1,659,622 A * 2/1928 Atamian ..... A46B 11/0013 401/286
2,626,087 A * 1/1953 Howard ..... B01L 3/0224 604/224
4,796,784 A * 1/1989 Spirk ..... A23G 9/28 425/297
5,505,041 A * 4/1996 Harlan ..... A45D 40/16 401/175
5,540,361 A * 7/1996 Fattori ..... A45D 40/04 401/175
11,691,785 B1 * 7/2023 Newlands, Sr. ..... B65D 83/765 222/520
2003/0057236 A1 * 3/2003 Delage ..... A45D 40/26 401/172
2004/0260247 A1 * 12/2004 Veasey ..... A61M 5/31585 604/207
2005/0103808 A1 * 5/2005 Zschiedrich ..... F16B 47/00 222/326
2009/0275916 A1 * 11/2009 Harms ..... A61M 5/24 604/211

FOREIGN PATENT DOCUMENTS

EP 709041 A1 * 5/1996 ..... A45D 40/04
GB 2296672 A * 7/1996 ..... B05C 17/00516
GB 2374070 A * 10/2002 ..... B05C 17/00513

* cited by examiner

*Primary Examiner* — Bob Zadeh

(57) ABSTRACT

Aiming to provide an alternative method for dispensing pasty products loaded into a wide range of package massively used today throughout the world, the present invention for "dispensing system for hollow round packages" generally relates to the field of dispensing devices designed to preferably dispense pasty products that are currently loaded into packages made from the most diverse materials and that can be replaced by ecologically suitable hollow round packages which are produced as from recyclable materials such as aluminum, cardboard and/or any other structure viable for this purpose.

4 Claims, 19 Drawing Sheets

Figures 5A, 5B:
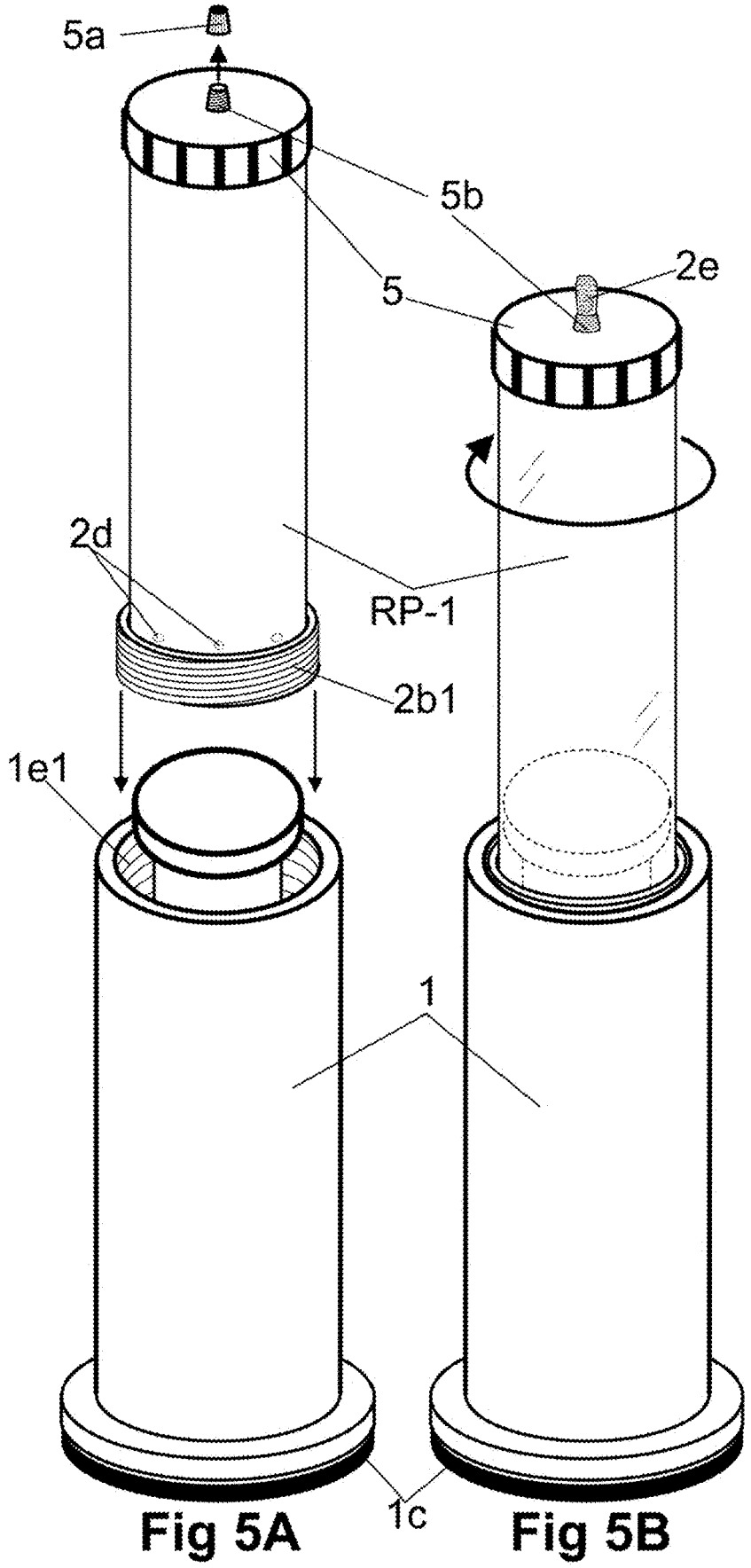

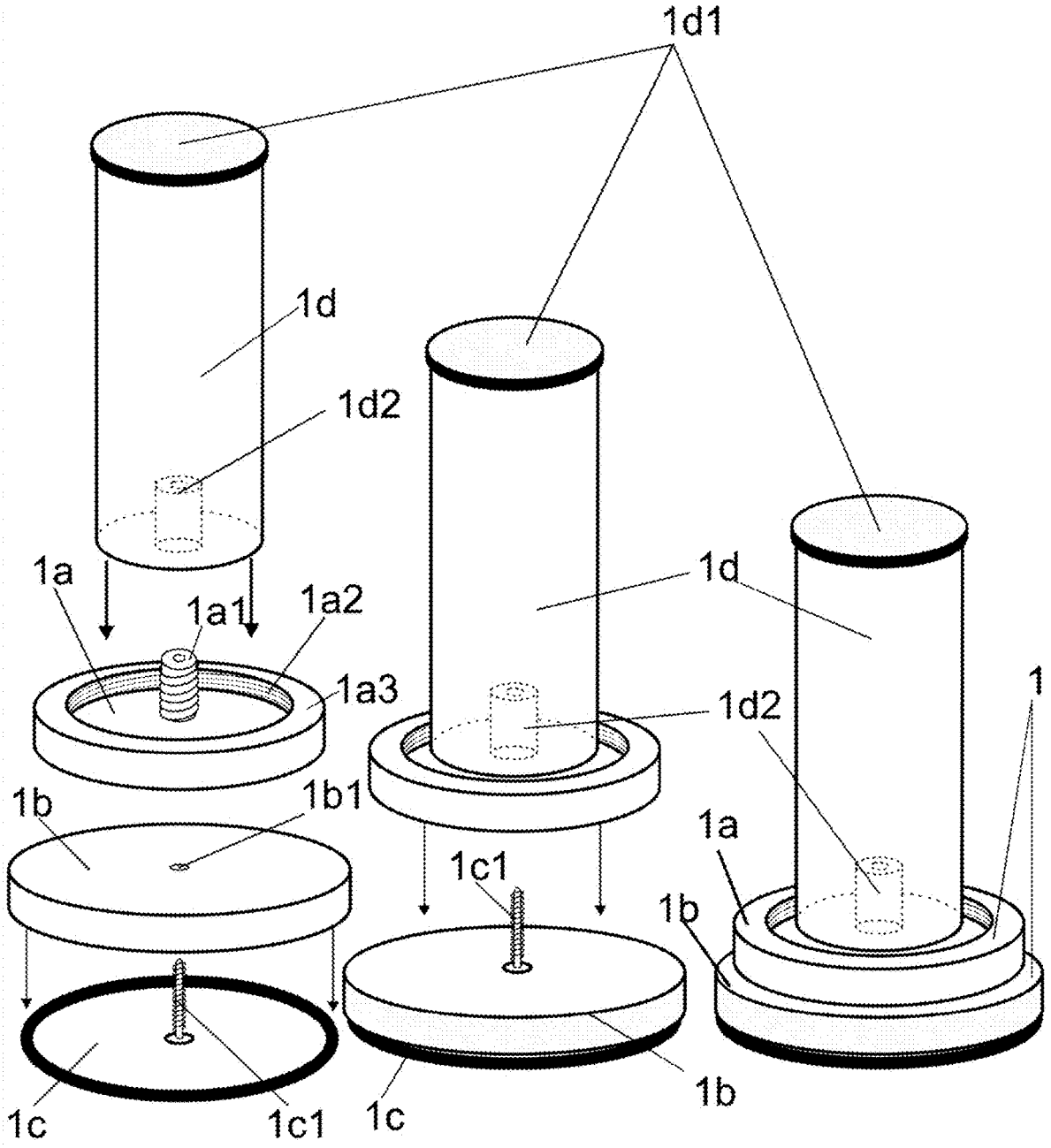
Fig. 1A1 Fig. 1A2 Fig. 1A3

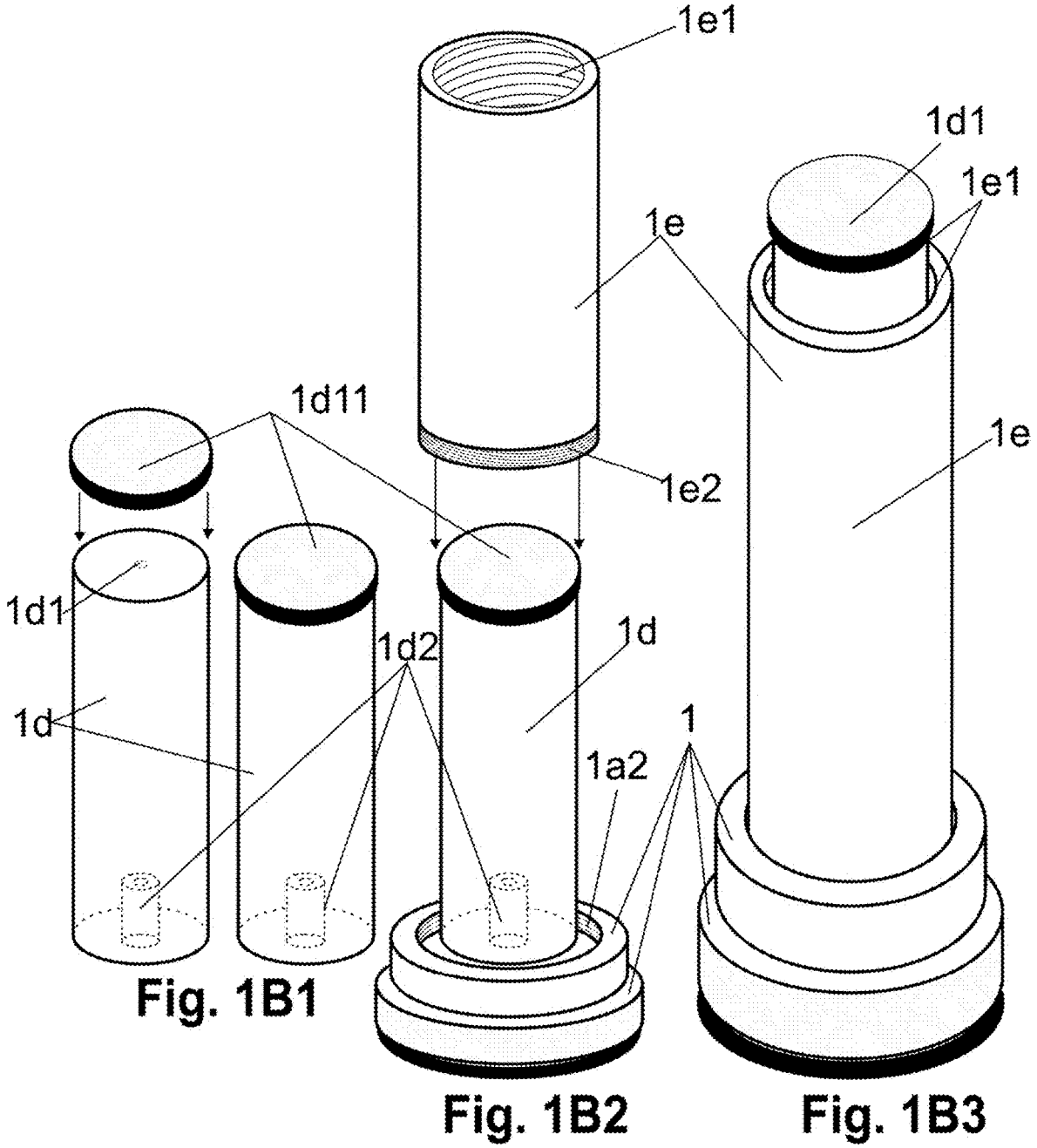
Fig. 1B1
Fig. 1B2
Fig. 1B3

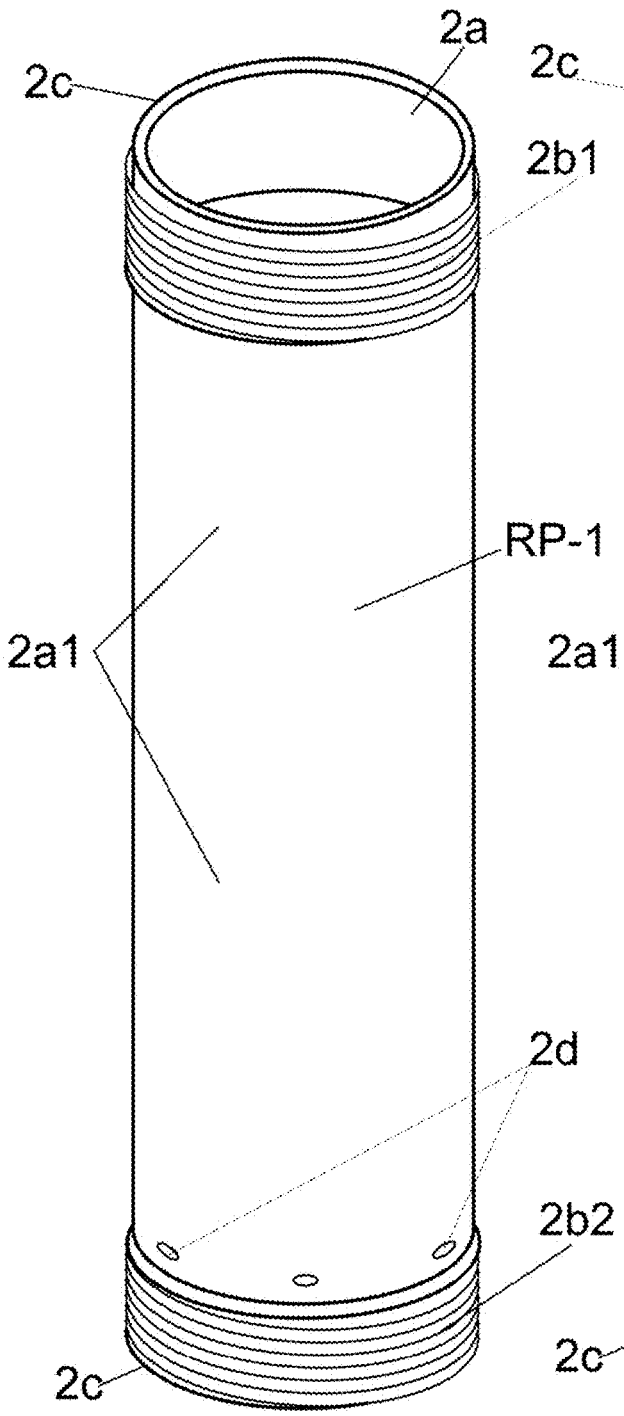
Fig. 2A1
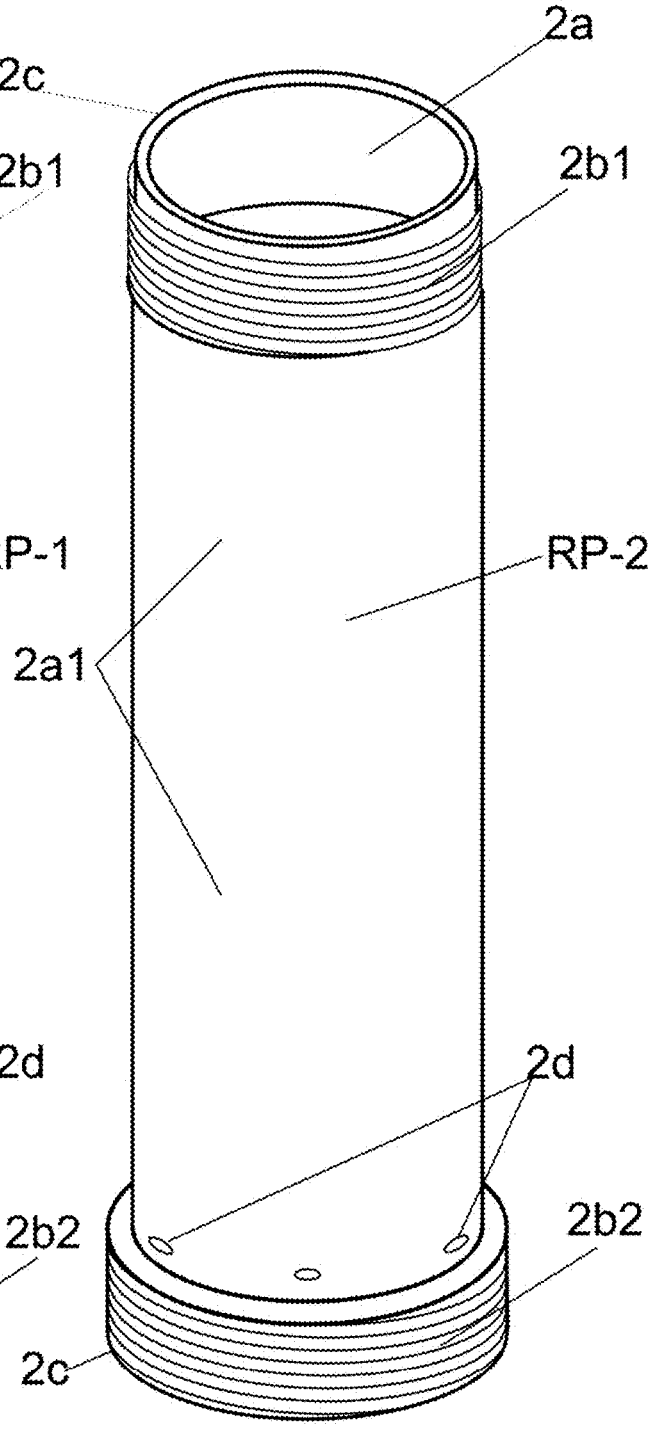
Fig. 2A2

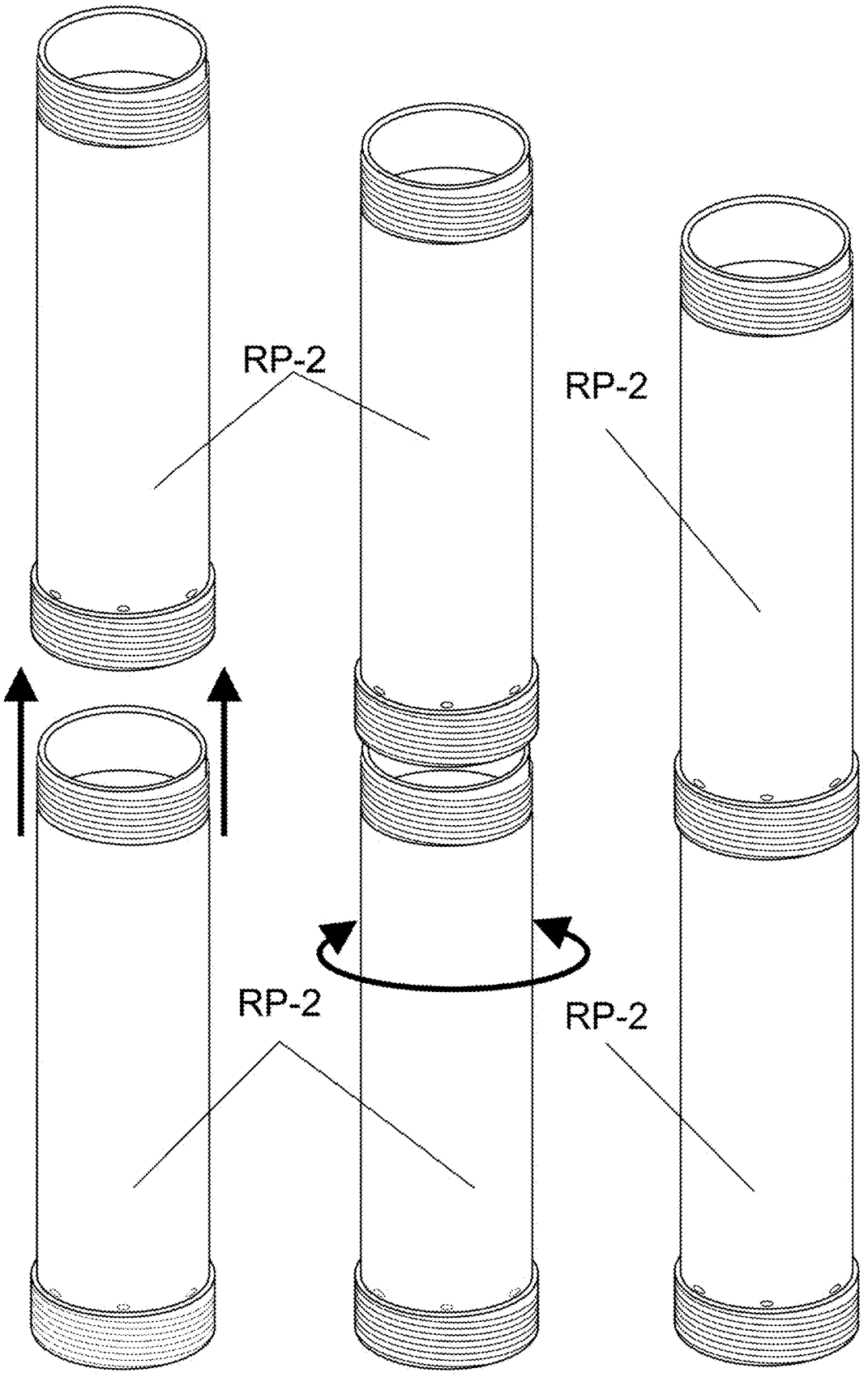
Fig. 2B1 Fig. 2B2 Fig. 2B3

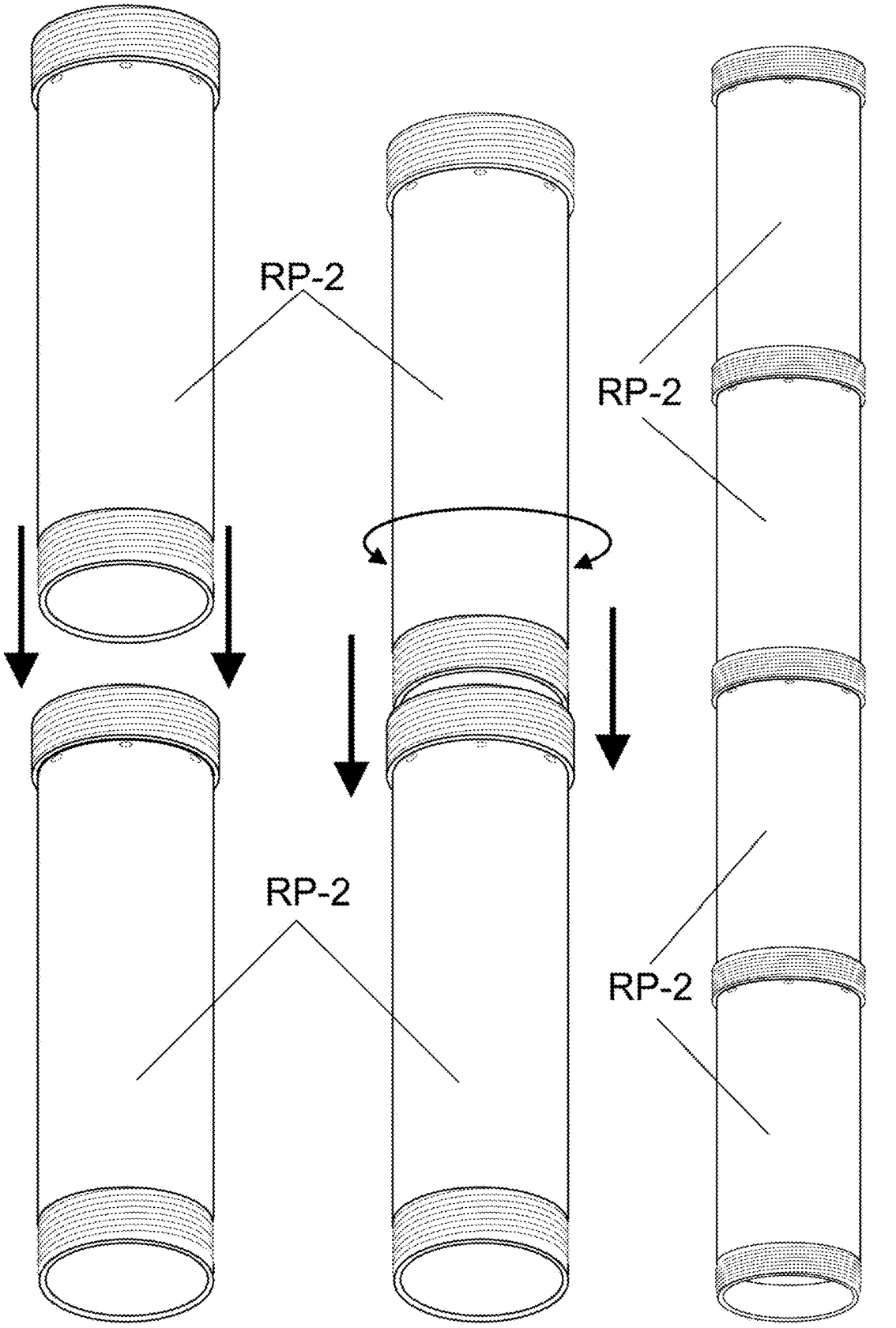
Fig. 2C1 Fig. 2C2 Fig. 2C3

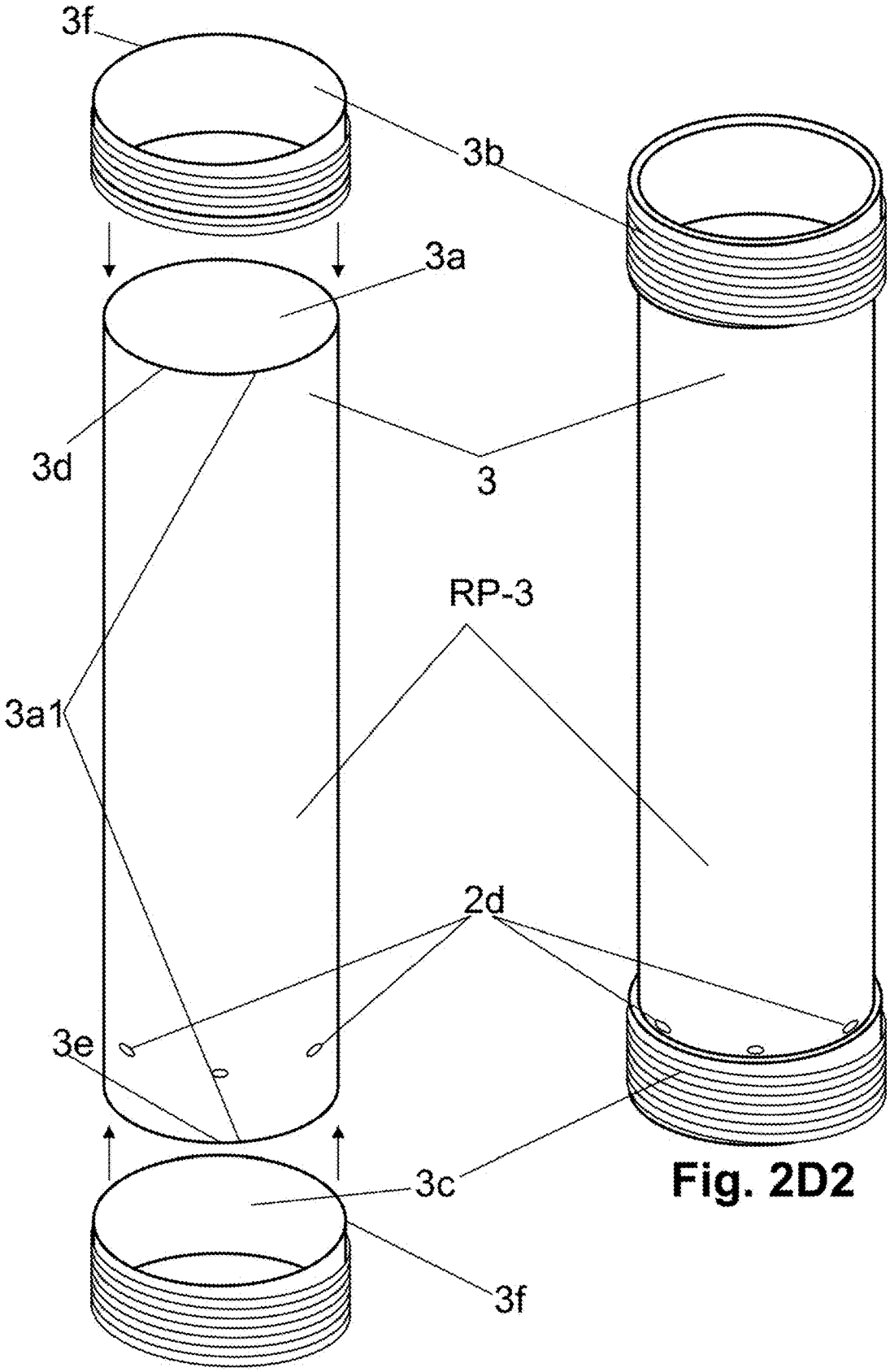
Fig. 2D2
Fig. 2D1

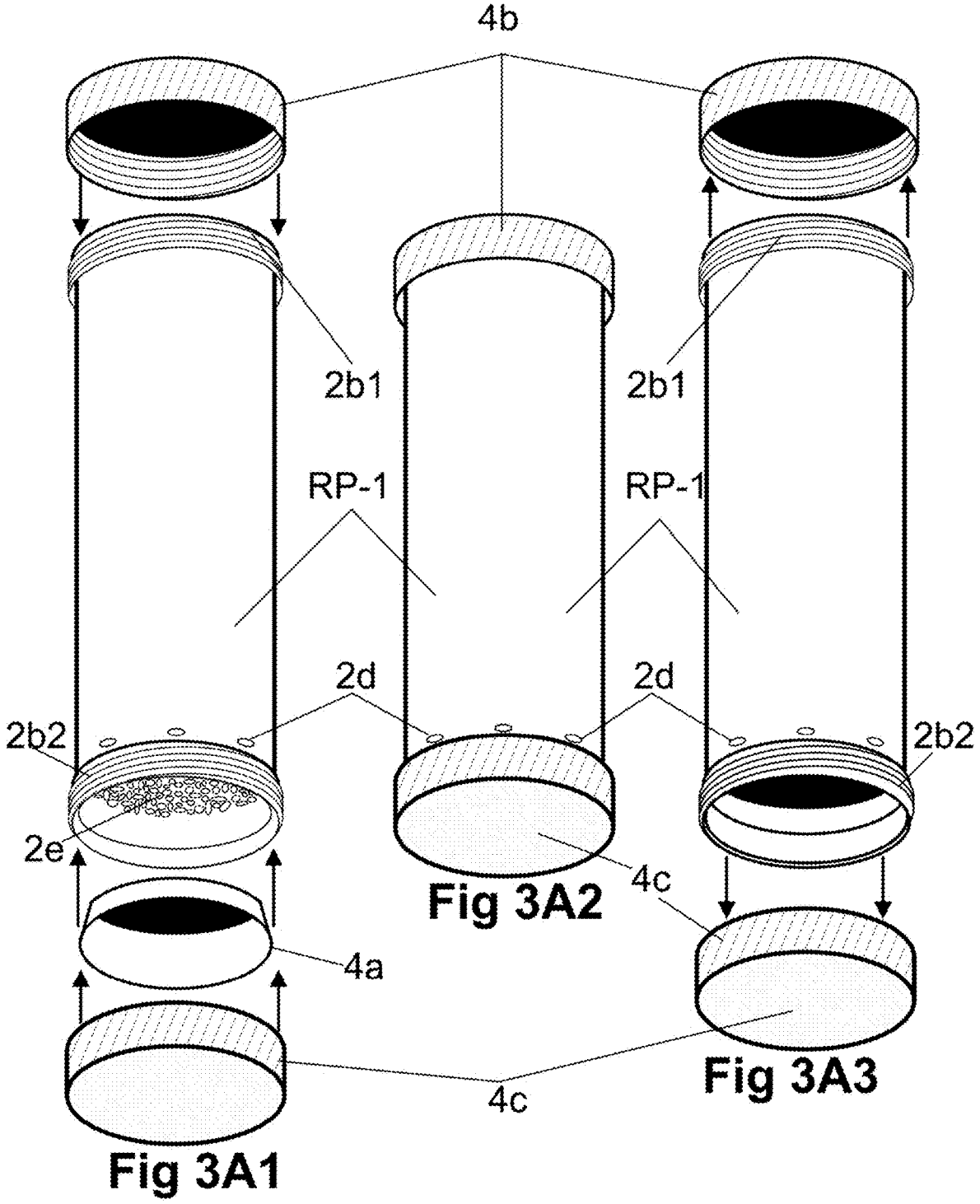
Fig 3A1
Fig 3A2
Fig 3A3

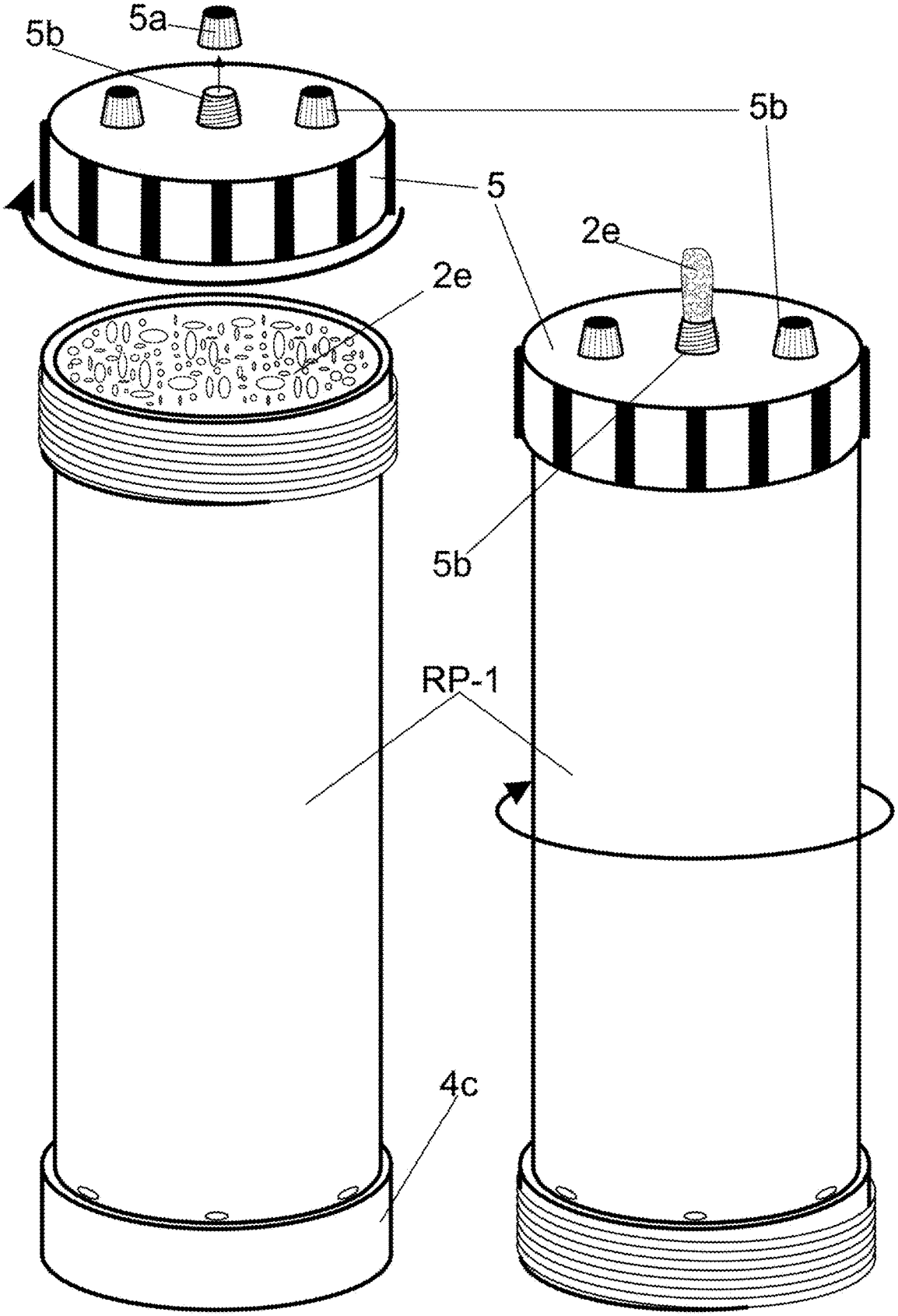
Fig. 3B1
Fig. 3B2

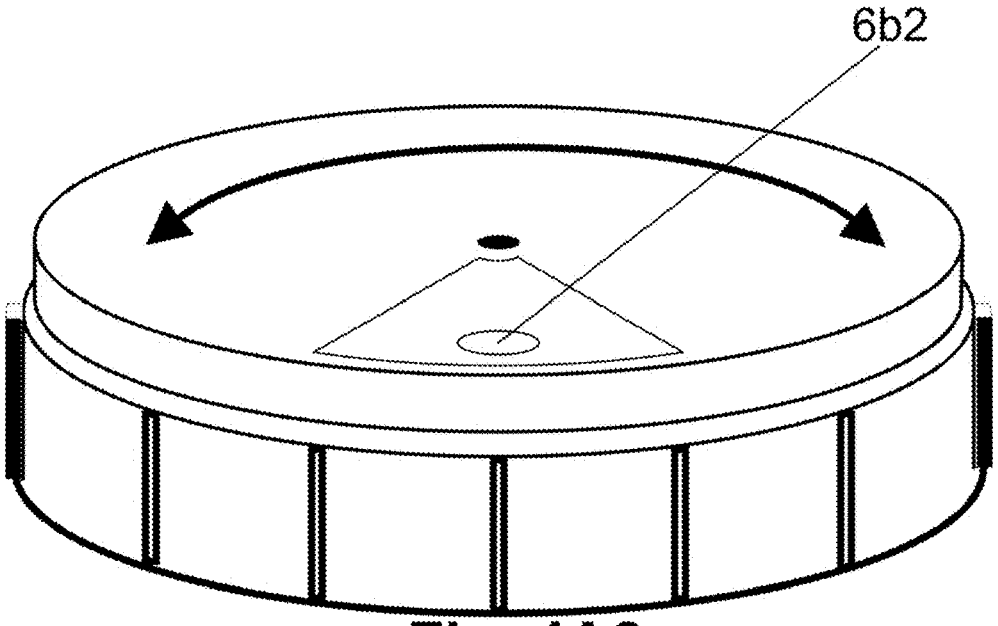
Fig. 4A2
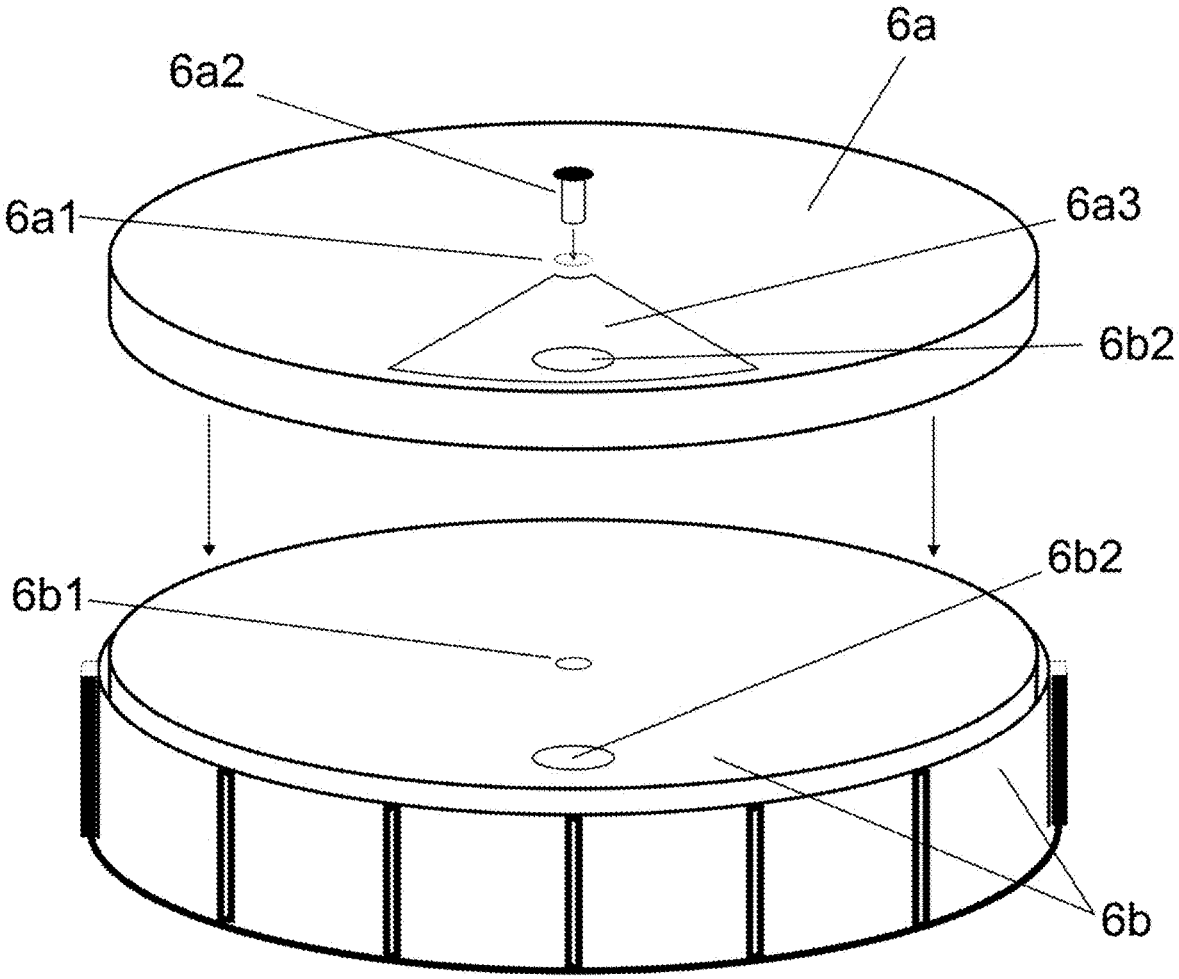
Fig. 4A1

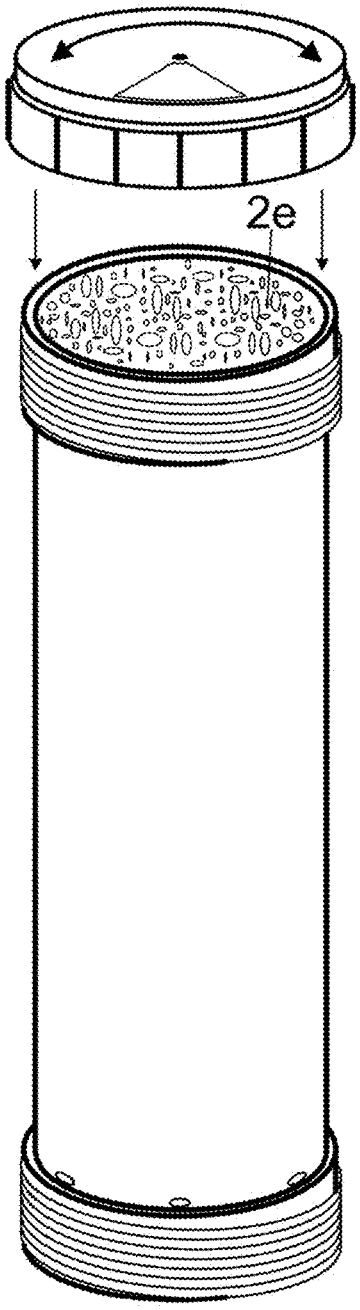
Fig. 4B1
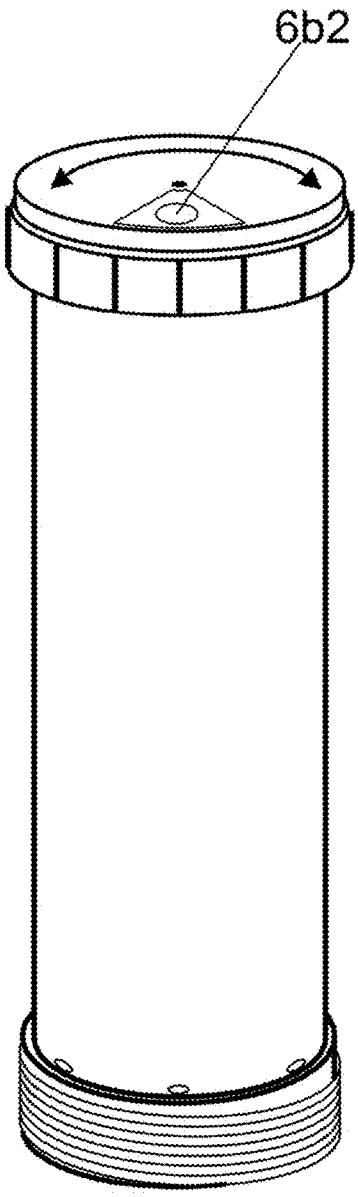
Fig. 4B2
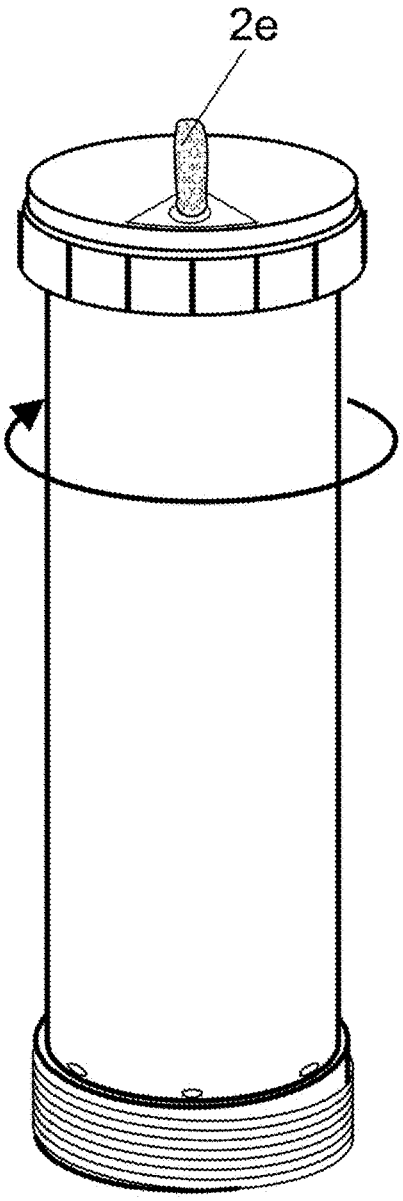
Fig. 4B3

10

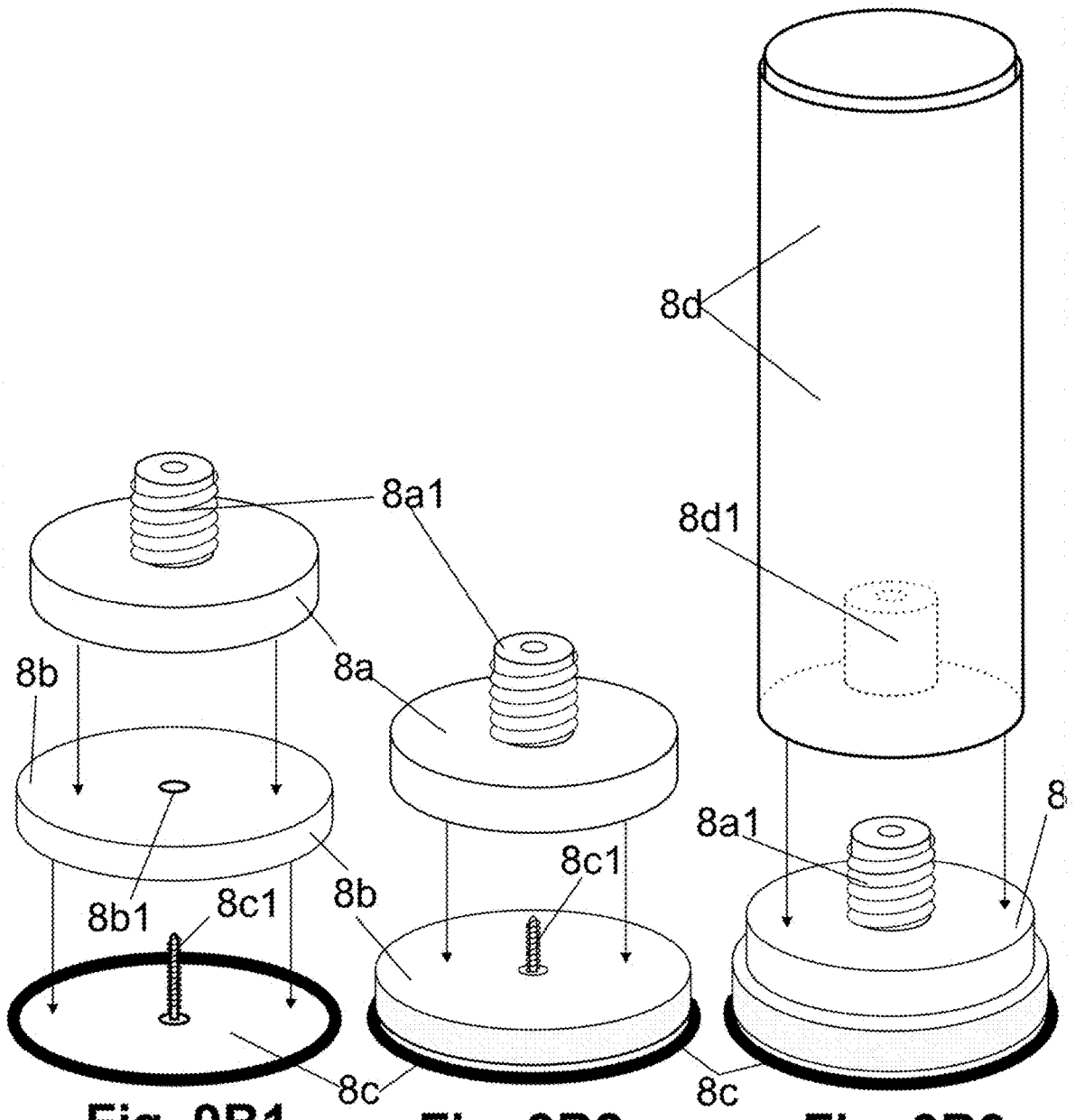
Fig. 9B1 Fig. 9B2 Fig. 9B3

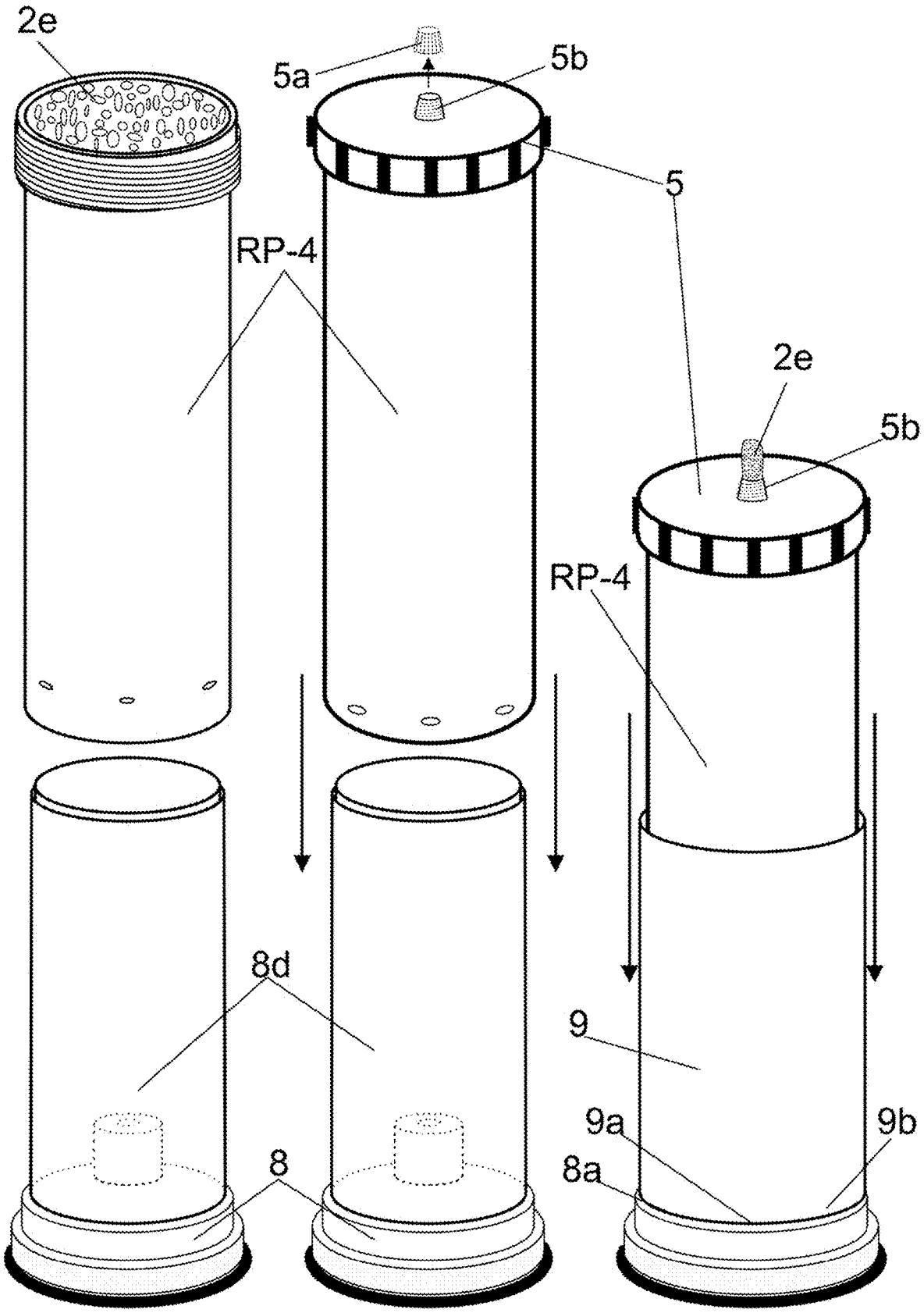
Fig. 9C1 Fig. 9C2 Fig. 9C3

DISPENSING SYSTEM FOR HOLLOW ROUND PACKAGES

CROSS-REFERENCE TO RELATED APPLICATION—PRIORITY CLAIM

This application claims the benefit of priority to the U.S. Provisional Patent Application No. 63/682,954, filed Aug. 14, 2024 02:31:24 PM Z ET entitled "ECO SUSTAINABLE DISPENSER".

The above-identified provisional Patent application, assigned to the same filer hereof, is incorporated herein by reference in its entirety.

1. FIELD OF THE INVENTION

Aiming to provide an alternative method for dispensing pasty products loaded into a wide range of package massively used today throughout the world, the present invention generally relates to the field of dispensing devices designed to preferably dispense pasty products that are currently loaded into packages made from the most diverse materials and that can be replaced from now on by ecologically suitable packages, including those produced from recyclable materials such as aluminum, cardboard and/or any other structure viable for this purpose, additionally allowing empty packages be exchanged by new loaded refills and appropriately sent for recycling, within the "circular economy" concept currently in force.

2. BACKGROUND 2.1. Since long ago, countless actions for creating or improving the functioning principles and utilities for the dispensing of products have been attempted and sometimes achieved, as it can be noted through the vast array of devices for this aim available in the market, such as the below listed examples:

- U.S. Pat. No. 10,888,889 granted by the USPTO on Jan. 12, 2021, to Brugger Gerhardt for "DISPENSER FOR DISPENSING LIQUID OR PASTY SUBSTANCES" which operates through the help of rotating piston pumps, rotary vane pumps, rotary piston pumps, gear pumps and similar pumps are used as rotating displacement pumps, without any similarity with the present patent claim.
- U.S. Pat. No. 5,011,317, granted by the USPTO on Apr. 30, 1991, to Guerret for 'DISPENSER INCLUDING A TRANSLATABLE PISTON' which proposes a mechanism for controlling the feed of a rod for dispensing its content, without any similarity with the present patent claim.
- U.S. Pat. No. 4,848,598 granted by the USPTO on Jul. 18, 1989, to the assignee Colgate-Palmolive Company for "DISPENSING DEVICE" wherein a hand-help pump type has an internal piston which is pulled up by a rod passing through the piston, which rod is moved by an actuator, without any similarity with the present patent claim.
- US20210163213 granted by the USPTO on Jun. 23, 1989, to Yan Jian for "DISPENSING PUMP AND MANUFACTURING METHOD THEREOF" in which the device's content is expelled by means of an air pump mechanism, without any similarity with the present patent claim.
- U.S. Pat. No. 3,128,923 granted by the USPTO on Apr. 14, 1964, to Gabler for "CONTAINER FOR RECEIVING AND DELIVERING PASTY SUBSTANCES" in which the device's content is expelled by means of a spring mechanism, without any similarity with the present patent claim.
- U.S. Pat. No. 4,511,068 granted by the USPTO on Apr. 16, 1985, to Bossina for "DISPENSER FOR PASTE-LIKE PRODUCTS" in which the device's content is expelled by means of a spring mechanism, without any similarity with the present patent claim.
- U.S. Pat. No. 4,598,843 granted by the USPTO on Jul. 8, 1986, to Foster for "TAKE-UP PISTON SHIPPING LOCK FOR VISCOUS PRODUCT DISPENSERS" in which the device's content is expelled by means of an atmospheric pressure-operated piston, without any similarity with the present patent claim.
- U.S. Pat. No. 4,139,127 granted by the USPTO on Feb. 13, 1979, to Gentile for "PLUNGER-TYPE DISPENSER WITH RATCHET ACTUATOR" in which the device's content is expelled by means for controlling the direction of rotation of a rotatable member, without any similarity with the present patent claim.
- U.S. Pat. No. 4,979,646 granted by the USPTO on Dec. 25, 1990, to Andris for "PASTE DISPENSER" in which the device's content is expelled by means of bellows, without any similarity with the present patent claim.

2.2. Additionally, it has been recently granted by the USPTO to the same applicant of the present application, the two patents listed below:

- U.S. Pat. No. 11,691,785 for DISPENSER WITH SELF-DEPLOYABLE TELESCOPIC ACTUATOR, issue date Jul. 4, 2023.
- U.S. Pat. No. 12,246,906 for ECOLOGICALLY SUSTAINABLE DISPENSER, issue date Mar. 11, 2025.

3. SUMMARY OF THE INVENTION

The present patent for "dispensing system for hollow round packages" has been conceived to combine functions and utilities resulted from the arrangement of three individual and self-complementary parts, as from which an integral body for an ecological dispenser for pasty goods is created, namely:

- Part 1: A round supporting base for the whole device formed by an assortment of pieces that will be better detailed ahead.
- Part 2: Varied types of closures, in accordance with the type of pasty good that is intended to be dispensed.
- Part 3: Complementary, fully hollow round packages with direct, open access at both ends where external threads are added, made up as from recyclable materials such as, and preferably, aluminum alloys, as it will be better described ahead.

It should be noted that the above referred Parts 1 and 2 are to be acquired only once for being permanently kept by end users in the long run, whilst Part 3 is intended to be continuously acquired for replacement, after the exhaustion of the content loaded to the previous package which is then ecologically disposed for recycling, being afterwards, continuously replaced by new fully loaded refills whenever the total extraction of its content is concluded.

The complementarity of parts 1, and 2 and 3 will be depicted ahead through relevant figures and descriptions.

In order to accomplish with the patent's fundamental aim of cherish the environment, the aforementioned replaceable container, from now on called round packages, is to be made up in favorable geometric shape and adequate materials for storing the selected products such as toothpaste, paste soap for bathrooms and kitchen sinks, paste hair shampoos and conditioners, food, spices and many more.

Thus, it is a paramount objective of the present invention to contribute for the improvement of the ecosystems against any inappropriate human disposal of toxic waste like, for instance, the currently in use plastic toothpaste tubes which according to some widely publicized reports are disposed in landfills in amounts surpassing the twenty billion units per year.

It is therefore strongly advisable that any and all packages used for storing pasty products complies at least with the following conditions:

- be made up, as previously described, from ecologically friendly materials conceived to have little or even no damaging effects to the environment, as in the case of the aluminum by-products that can be endlessly recyclable within a circular economic strategy aimed to achieve environmental targets fully compatible to a toxic-free ecosystem;
- be shaped in a geometric format that prevents the presence of solid residues inside the packages upon the exhaustion of its original contents which, if anyway left in insignificant amounts might be wiped out during its final washings at the recycling plant.

Significant examples of this alarming threat might be taken from the way plastic toothpaste packages currently in use are being presently delivered for consumption in inadequate plastic tubs which, in accordance to reports published through the internet links below, surpass the astonishing amount of twenty billion units being disposed yearly to landfills with little or even none recycling utilization:

- https://www.colgatepalmolive.com/en-us/who-we-are/stories/recyclable-toothpaste-tube-recycle-me-packaging-us
- https://www.ndtvprofit.com/business/can-toothpaste-tubes-be-recycled-colgate-says-its-tubes-are-now-recyclable Considering the complicated and sometimes inefficient or even impossible recovering of the currently used toothpaste packages, recycling of empty toothpaste plastic tubes could be disturbing for recycling mainly due to a certain amount of product that is always left inside those empty packages, representing so a relevant issue to be considered by recyclers.

In comparison, the fully hollow round packages disclosed by the present patent gives the option of not be merely disposed at landfills, but selective collected and handed to final recyclers since they will be virtually free from residues left inside them upon use, which total cleaning at the recycling mill will be quite facilitate by the fact that it is fully hollow from one open end up to the other, contributing this was for increasing the activities of this specific recycling economic sector.

Therefore, replacing the currently used plastic packages by the fully recyclables packages of the present invention represent a disruptive choice towards the circular economy even when novel models to be conceived be made up as from plastic raw material, but within the concept of fully hollow round packages, as hereby disclosed.

It is another objective of the present invention to disclose a method, and all necessary parts and means needed for creating an "dispensing system for hollow round packages" capable for replacing unsuitable package materials presently applied for storing an array of utility products, by adequate ecological packages.

It is another objective of the present patent to offer a device that will allow the dispensing of products through a friendly and easily manipulating device, additionally benefiting specific populations formed by kids, elder and disable people.

It is another objective of the present patent the creation of an "dispensing system for hollow round packages" which brings to the users the ability to periodically replace empty packages by new sustainable refills fully loaded with renewed amounts of the desired products.

The above referred functions and effects might be represented and achieved, without any limitation, through feasible and adequate means, as depicted by the related drawings hereby embodied.

4. DESCRIPTION

4.1. Brief Description of the Drawing

FIGS. 1A1 up to 1B3 represent, in perspective view, the assembling process of the round supporting base for the whole "dispensing system for hollow round packages".

FIG. 2A1 disclose a paradigmatic round package model (RP-1), fully hollow longitudinally and preferably made up as from an aluminum tube gotten through impact extrusion of aluminum slugs, or any other feasible method, as it will be further explained, being fully opened at both of its ends where sets of threading lines has been externally added at both ends of the package, and also internally added just to its thicker end.

FIG. 2A2 disclose the same round package disclosed in FIG. 2A1, however with an enlarger diameter at the lower end.

FIGS. 2B1 till 2B3 and from 2C1 till 2C3 disclose in perspective views, how a given number of round packages can be interconnected in an assembling process to form an elongated chain of round packages for general purposes and applications.

FIGS. 2C1 to 2C3 disclose, now in perspective, bottom view, the same disposition of round packages to form an elongated chain for general purposes and applications.

FIGS. 2D1 and 2D2 reveal a constructive method for the tight attachment of independent loose sleeves fitted with external portions of threads, to the open ends of a flat round package.

FIGS. 3A1 up to 3A3 shows up, in perspective view from below, the closure of the two opened ends of a round package by using both of its external threaded ends for this aim, after the round package have been loaded with the desired content.

FIGS. 3B1 and 3B2 disclose a model of double action, round maneuverable closing cap fitted with lids and nozzle, which is to be manually attached by users to a round package before starting the extraction of the package's content.

FIGS. 4A1 to 4A2 disclose another type of double action maneuverable closing cap which is also to be manually attached by users to a round package before starting the extraction of the package's content.

FIGS. 4B1 to 4B3 disclose the movement for getting the double action maneuverable cap dully fixed at a round package for the controlled extraction of its content.

FIGS. 5A and 5B represent, in perspective view, the assembling process of a round package fitted with threads at both ends, to an already assembled supporting base.

Figure 6A:
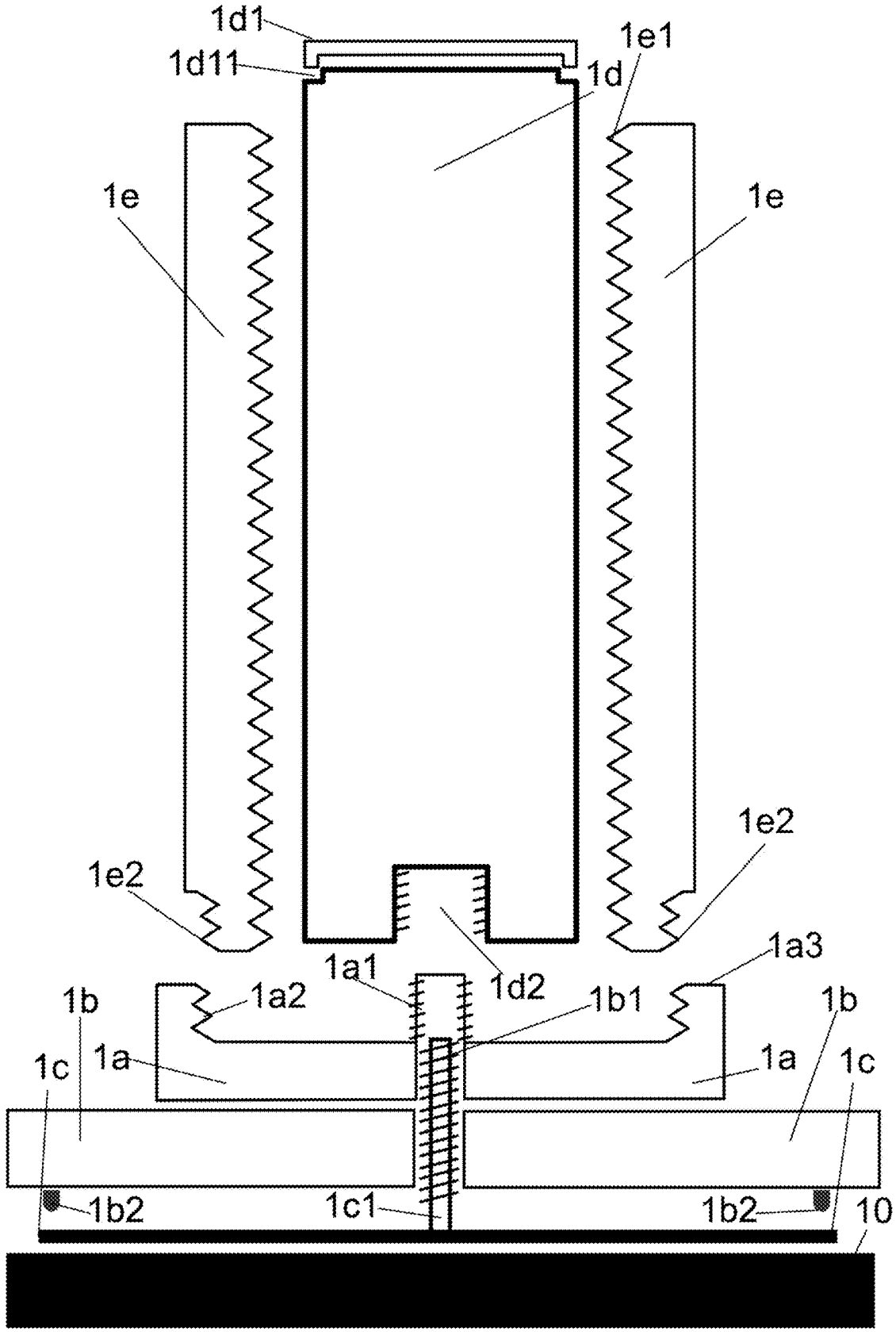

FIGS. 6A up to 6C depict in a cut frontal view, the same assembling process of the round supporting base for the whole device, as shown up before in perspective through the FIGS. 1A1 up to 1B3.

Figure 7A:
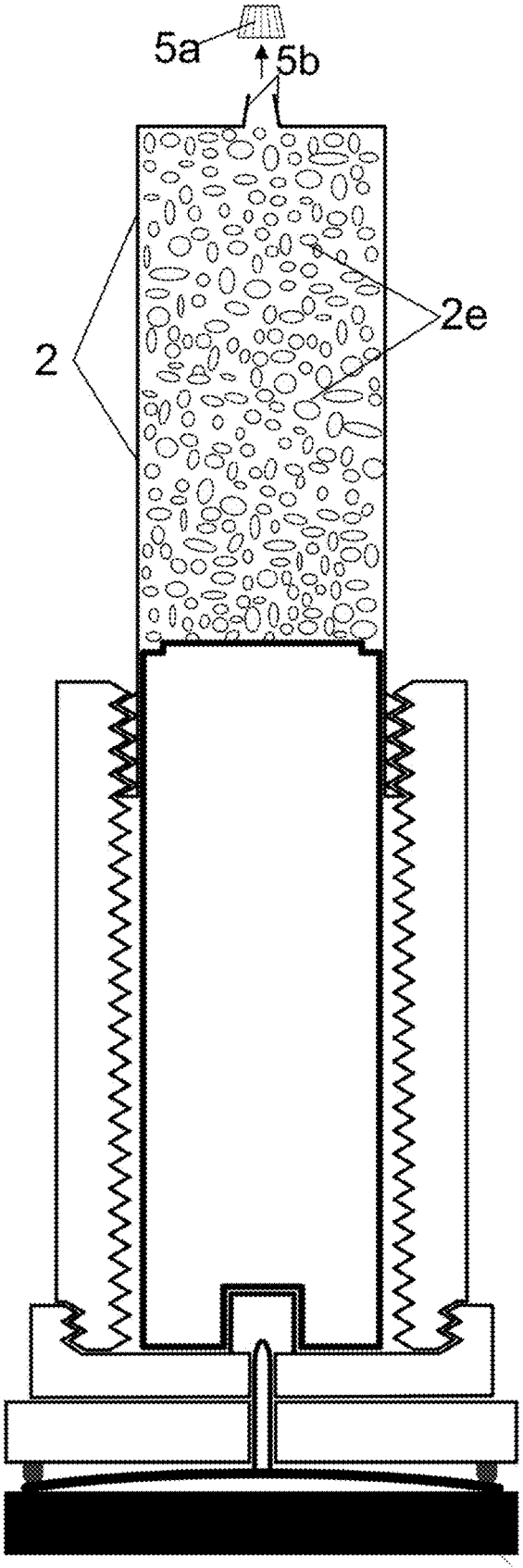
Figure 7B:
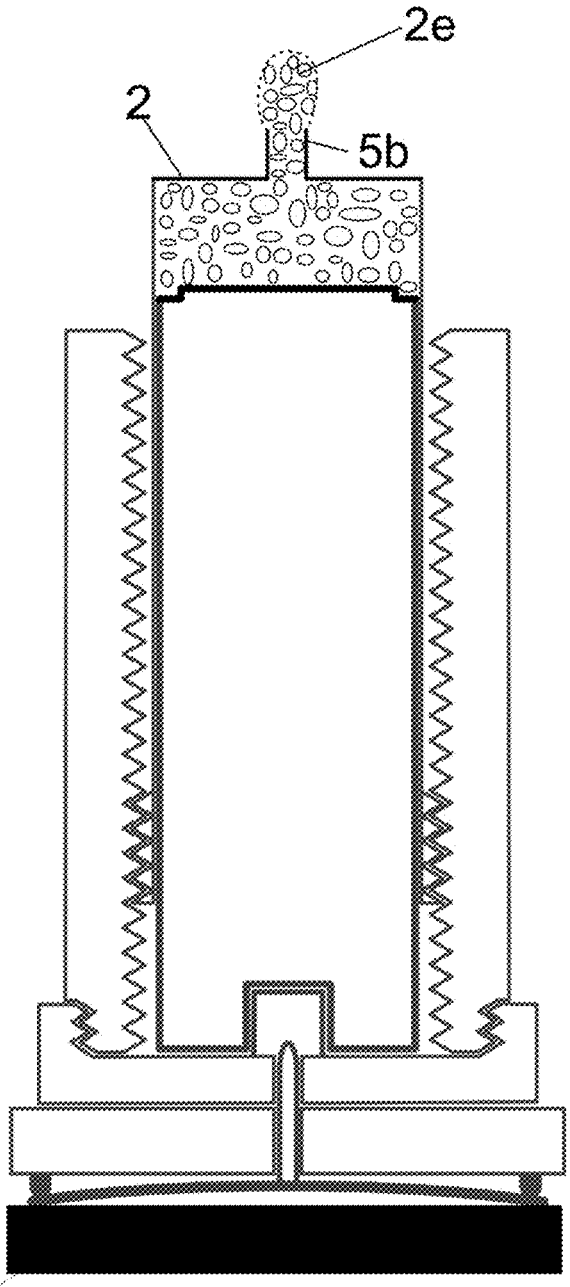

FIGS. 7A and 7B disclose in cut frontal view, the steps taken for extracting the stored product loaded to the refillable round by using a round supporting base.

Figure 8B:
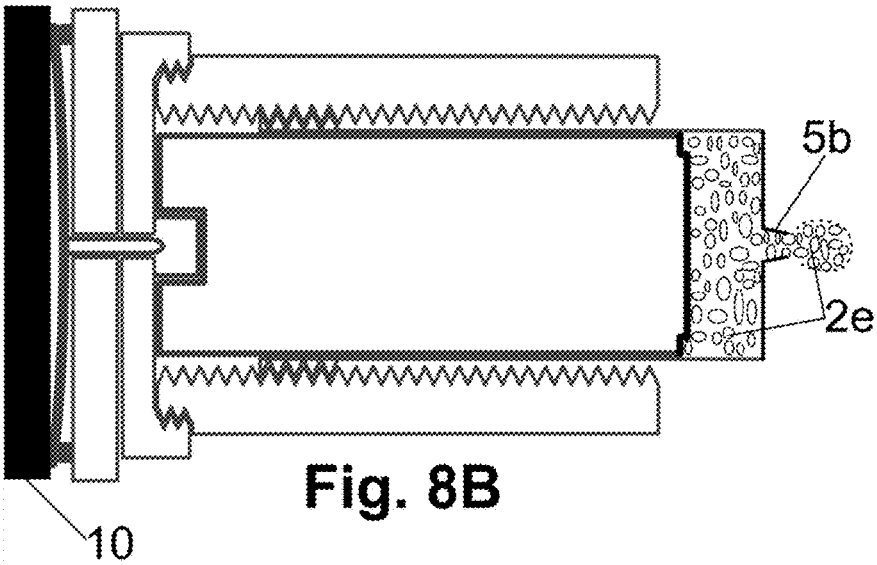
Figure 8A:
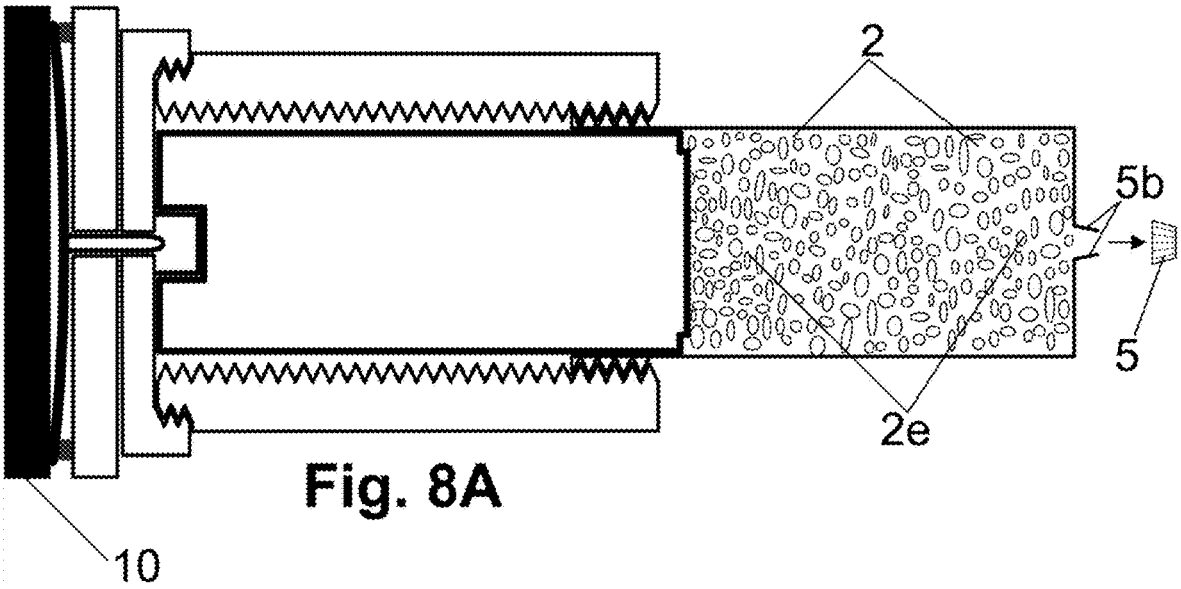

FIGS. 8A and 8B expose the method to make the entire "dispensing system for hollow round packages" be horizontally sustained on the vertical walls through the use of a suction cup therein introduced.

Figure 9A:
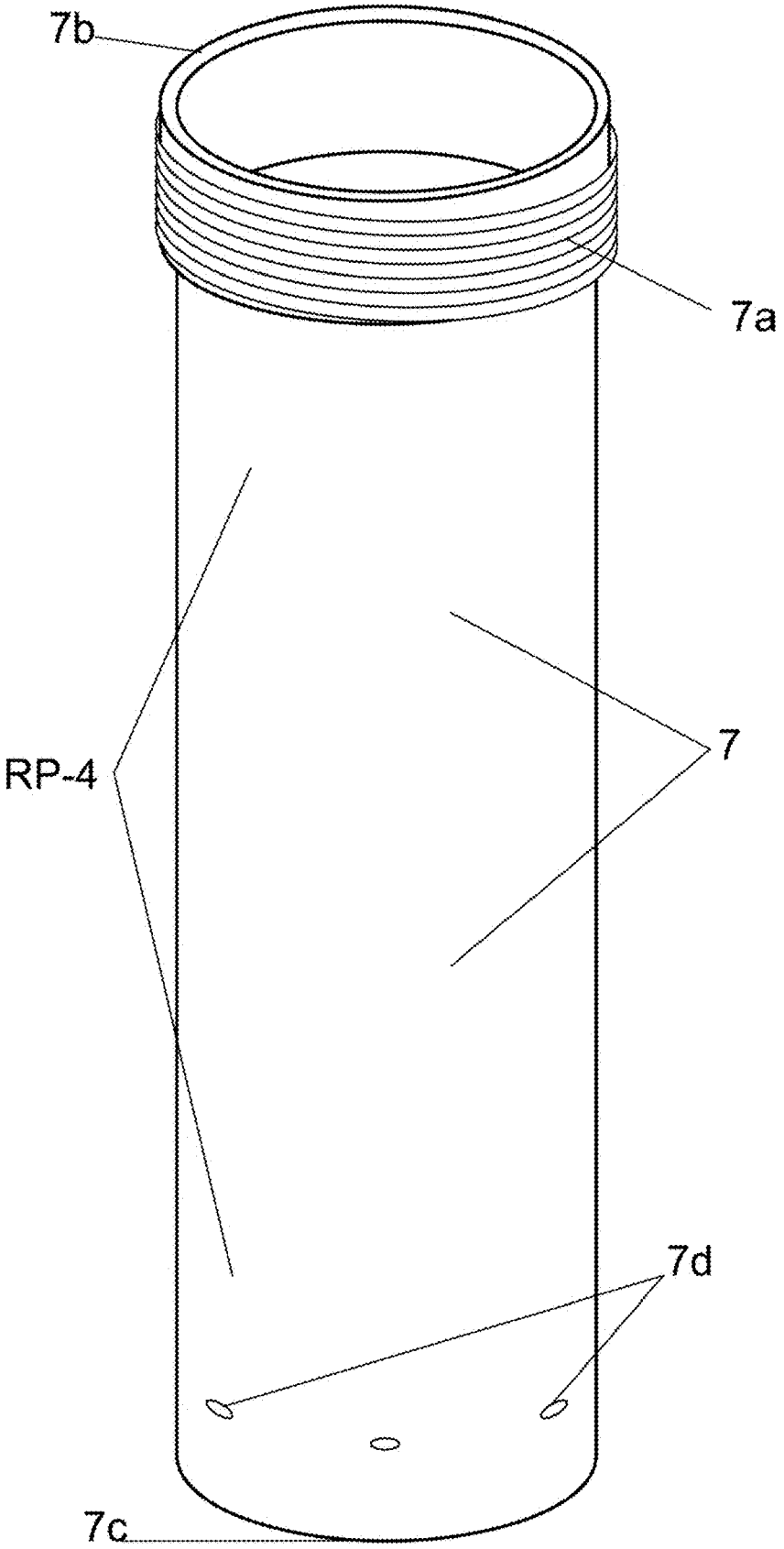

FIG. 9A disclose another model of an adapted round package, fitted with portions of threads only at its upper end.

FIGS. 9B1 up to 9C3 depict an alternative model of "dispensing system for hollow round packages" fitted with portions of threads only at its upper open end in which the extraction of the stored content is obtained through the direct application of user's muscle strength over the round package towards the piston centrally positioned at the round supporting base.

4.2. DETAILED DESCRIPTION OF THE DRAWINGS

Through FIGS. 1A1 up to 1B3 it is disclosed in perspective view, the assembling sequence for getting a round supporting base (1) for the whole device dully mounted.

Thus, in FIG. 1A1, it can be seen four, out of the five individual parts that form the supporting base (1) for the whole "dispensing system for hollow round packages", as follows:

Part 1—an upper circular half (1*a*) fitted with a centralized and externally threaded screw (1*a*1), also comprising the insertion of an internally threaded stretched portion (1*a*2) at the elongated wall (1*a*3).

Part 2—a lower circular half (1*b*), fitted with a central orifice (1*b*1) aimed to accommodate a centralized threaded pin (1*c*1) existing at the suction cup (1*c*), as well as an opposition circle located below the lower circular half, not shown in FIG. 1A1.

Part 3—a suction cup (1*c*) equipped with a centralized threaded pin (1*c*1), hereinafter incorporated into the dispenser to fulfill the important function of keeping the entire device firmly attached to a flat surface, whether vertically or horizontally, so that it can be more easily handled by children, elderly, or disabled people.

Part 4—a central piston (1*d*) equipped at its upper end with a socket (1*d*1) not shown in FIG. 1A1, intended for threading a screw and located in the center of an optional upper sealing disc (1*d*11), made from resilient materials such as rubber, silicone or any other capable of acting at the same time as a sealant to prevent the leakage of goods stored in the round package (RP-1) disclosed by FIG. 2A, when pressed against that sealing disc (1*d*11), as well as to allow it to easily slide upwards when coming into contact with the internal walls of the round package (RP-1) in order to push the stored goods towards the nozzle (5*b*), as will be better described in the following figures, also having the central piston (1*d*) at its lower end, an internally threaded socket (1*d*2) intended to allow its fixation at the centralized screw (1*a*1), located in the center of the upper circular half (1*a*), as shown in FIG. 1A1.

On FIG. 1A2 it is firstly disclosed the attachment of the internally threaded socket (1*d*2) existing in the threaded central piston (1*d*) to the centralized and externally threaded screw (1*a*1) existing at the center of the upper circular half (1*a*), and secondly, the upwards movement for the introduction of the centralized threaded pin (1*c*1) existing at the suction cup (1*c*) throughout the central orifice (1*b*1) existing at the center of the lower circular half (1*b*), being this preliminary assembling phase completed, as disclosed by FIG. 1A3.

In continuation of the previously described assembling sequence, FIG. 1B1 depicts the positioning of the upper sealant-disk (1*d*1) over the upper end of the central piston (1*d*) which is fitted with a lower central socket (1*d*3) for threading therein a screw member not shown in this figure, to assure a firm attachment of the two elements, if needed.

FIG. 1B2 shows the movements through which the round supporting base (1) of the "dispensing system for hollow round packages" receives the fixation of the auxiliary threaded tubular member (1*e*), which is equipped with internal threading lines (1*e*1) along its length, also having a limited number of external threading lines (1*e*2) at its lower end to be used for screwing said auxiliary threaded tubular member (1*e*) to the internally threaded stretched portion (1*a*1), located at the upper circular half (1*a*) of the round support base (1), thus causing, as shown in FIG. 1B2, the final assembling of the round support base (1) which is now ready to receive the round package (RP-1) disclosed by FIG. 2A, for mechanically starts the extraction of its contents, as illustrated through the next figures.

FIG. 1B3 gives a perspective frontal view of the round supporting base (1) fully assembled and ready for receiving the attachment of a round package (RP-1) for which a space (1*e*1) between the upper end of the auxiliary threaded tube (1*e*) and the top of the upper sealant-disk (1*d*1) is created to allow a smooth attachment of the round package (RP-1) to the auxiliary threaded tube member (1*e*), up to a point where the pasty product has been loaded.

Among many feasible models which might be gotten either through impact extrusion, casting, CNC—Computer Numerical Control or any other type of efficient constructive method, FIGS. 2A1, 2A2, 2D1 and 9A, disclose four different versions of round package (RP) of the present application, being all of them fully hollow along their longitudinal length and fitted with selective portions of external and/or internal threaded lines, pending on the specific version referred to, exhaustion holes in any desired quantity, which are positioned right below the material limits of the pasty product loaded therein, being its main function the creation of an open atmosphere that will permit the head of the internally threaded central piston (1*d*) to smoothly proceed up to the limits of the pasty product therein stored, so that the extraction of the loaded content could be efficiently performed, as desired.

Thus, FIGS. 2A1 and 2A2 disclose two versions of round packages, (RP-1) and (RP-2) which, although being quite similar, differ one from the other due to the larger diameter measure of its upper end when compared to the thinner diameter of its lower end, as follows:

A. FIG. 2A1 exhibits a paradigmatic fully hollow round package (RP-1) that has the same diameter measures at both ends.

B. FIG. 2A2 discloses an alternative round package (RP-2) having at its lower end an slight larger diameter to allow the threading therein of the upper end of another similar round package (RP-2), as exhibited through next FIGS. 2B1 till 2B3 that disclose in upper perspective view how the thinner end a the round package (RP-2) fitted with internal portions of threads is firstly engaged on top at another identical round package (RP-2), as shown by FIG. 2B2, to be totally screwed and fixed at the thicker end of the round package (RP-2), as shown by FIG. 2B3, conforming this way a continuous pipeline in the desired length, being such a sequence once again reproduced in a perspective view from the bottom through FIGS. 2C1 till 2C3.

C. On FIGS. 2D1 and 2D2 an optional constructive method for getting a threadable round package (RP-3) by using attachable screw-on sleeves independently manufactured is disclosed.

Thus, FIG. 2D1 discloses a round plain aluminum tube segment (RP-3) fully hollow (3*a*) all over its internal longitudinal length (3*a*1), but not having yet, at its both ends (3*b*) and (3*c*) threaded sleeves (3*f*) fitted with external threading, as shown in FIG. 2D1, which will be sequentially incorporated under pressure around the upper extremity (3*d*) and optionally, also around the lower extremity (3*e*) of the aluminum tube (RP-3), as exhibited through FIG. 2D2.

To be tightly adhered to the round flat aluminum tube (RP-3), the individually produced externally threaded sleeves (3*f*) can preferably assume a slightly conical shape, having at the same time a slightly larger internal diameter when compared to the external diameter of the plain round package (RP-3), aimed to allow its firm insertion and permanent retention over the upper (3*d*) and lower (3*e*) extremities of the plain round package (RP-3), eventually with the addition of reinforcing glue.

D. FIG. 9A discloses an adapted round package (RP-4) whose functions and applications are further detailed as from page 17/19 of this application.

FIGS. 3A1 till 3A3 disclose in perspective view, the attachment and withdrawal process of package's closing caps (4) to a round package (RP-1) during the loading process at the producing plant, as disclosed in FIG. 3A1, up to the removing process of the caps by the end users, as disclosed by FIG. 3A3.

Thus, FIG. 3*a*1 depicts the routine needed for filling a paradigmatic round package (RP-1) with the selected pasty good at the producing plant which comprises the steps of:

a—A tight insertion of an optional inner seal (4*a*) which can be made up, for instance, as from aluminum thin sheets, through the lower end (2*b*2) of the round package (RP-1) up to a point above the exhaustion holes (2*d*) in order to create an open atmosphere between the two elements which will permit an upper sealant-disc (1*d*1) located at the head of the central piston (1*d*), not shown in this figure, be smoothly introduced up to the limits of the pasty product (2*e*) therein stored, so that the extraction of the loaded content could be smoothly and fully performed, as desirable.

b—The threading of the lower cap (4*c*) to the external threads (2*d*) located at the bottom of the round package (RP-1).

c—The threading of the lower cap (4*c*) to the lower external threads (2*b*2) located at the bottom of the round package (RP-1) in order to get it fully loaded and hermetically closed, as shown in FIG. 3A2, being therefore ready to be send to retailers and thence, be acquired and handled by end users.

d—As shown in FIG. 3A3, to start using the "dispensing system for hollow round packages" end users will firstly remove the upper threaded cap (4*b*) which, according to FIGS. 3B1 and 3B2, will be then replaced by the round maneuverable closing cap (5) fitted with adequate lid (5*a*) and nozzle (5*b*) in any desired format and quantity on its top and then starting the extraction of the stored pasty goods (2*e*) through the nozzle (5*b*), just by clockwise rotating the round maneuverable closing cap (5) along with the round package, as indicated by the arrow on FIG. 3B2.

e—On FIG. 3B2 it can also be noted that the lower threaded cap (4*c*) has been already removed to expose the lower external threads (2*b*2) of the round package, allowing therefore its screwing at the round supporting base (1), as it will be better explained through FIGS. 5A and 5B.

It must be noted that aiming to speed-up the assembling line at the production unit, both upper threaded cap (4*b*) and lower threaded cap (4*c*) may be optionally replaced by aluminum foil seals during the filling process of the round packages (RP-1).

FIGS. 4A1 and 4A2, as well as 4B1 up to 4B3 disclose an alternative model of double-action closure (6) for the upper external threads (2*b*1) of the round package (RP-1), typically composed by two overlapping sections being the upper section (6*a*) fitted with a central hole (6*a*1), through which a fixing pin (6*a*2) is inserted and then compressed so that the two upper and lower parts might be tightly connected, having the lower section (6*b*) threading lines at its internal wall, a central socket (6*b*1), and a discharging opening (6*b*2) through which the stored pasty good (2*e*) will be extracted whenever the double-action closure (6) is clockwise rotated, as indicated by the arrow and exhibited through the sequence of actions disclosed on FIGS. 4B1 up to 4B3.

After the full assembling of the round supporting base (1) is completed and the round package (2) has received the attachment of the round maneuverable closing cap (5), becoming therefore ready to be threaded inside the auxiliary threaded tube member (1*e*), which has already been threaded at the supporting base (1), users should take additional measures for getting the "dispensing system for hollow round packages" ready for use, as firstly disclosed through the perspective view of FIGS. 5A to 5B and sequentially exhibited through frontal cut views on FIGS. 6A to 6C, 7A to 7B, and 8A to 8B.

Thus, in FIG. 5A it can be noted a fully loaded round package (RP-1) from which both the upper closing cap (4*b*) and the lower closing cap (4*c*) have been removed which causes, from one side, the exposition of its external threading (2*b*1) positioned at its bottom end that will be directly threaded into the internal threading (1*e*1) of the round package (2), and from another side the attachment of a round maneuverable closing cap (5) fitted with lids (5*a*) and nozzles (5*b*) through which the pasty goods (2*e*) previously stored will be extracted when the round package (2) is clockwise twisted by users, as indicated by the arrow on FIG. 5B, which also gives a complete view of the "dispensing system for hollow round packages" already bearing all of its three parts namely, the round supporting base (1), the round package (2) and the round maneuverable closing cap (5) with lids (5*a*) that collectively form the device whose patent is presently being claimed though this application.

FIGS. 6A up to 6C disclose in frontal cut view the progressive assembling routine performed to get the round supporting base (1) fully mounted and dully fixed in a permanent horizontal or vertical solid surface (10) such as a bathroom sink or kitchen sink, just awaiting the attachment of the next round package (2) to become ready for immediate use.

Figure 6B:
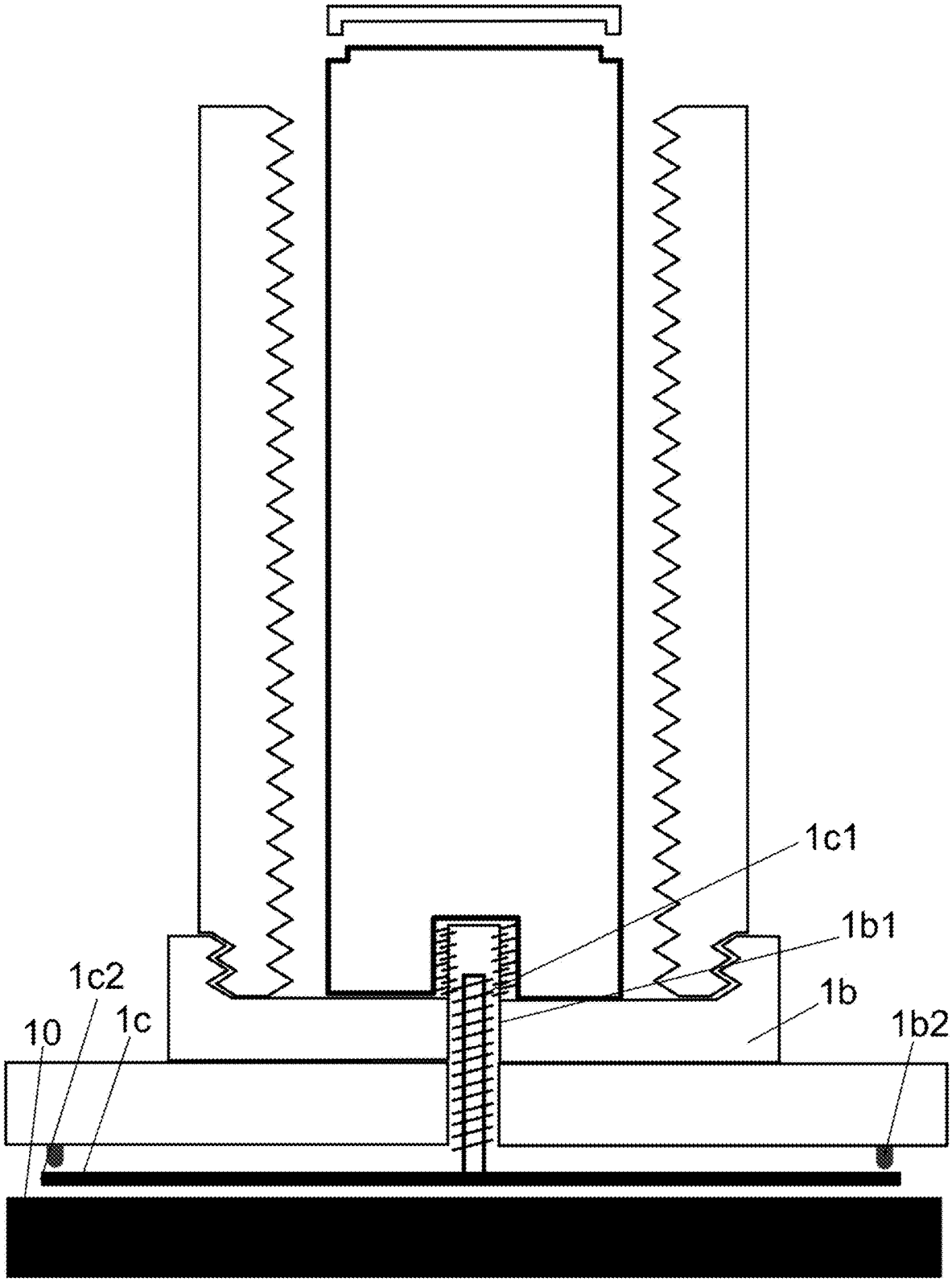

Thus, through the cut view disclosed by FIG. 6A it can be seen the schematic disposition of the various individual elements that, when get together, collectively form the round supporting base (1), after they have been assembled all together and fixed over a horizontal or vertical solid surface (10), namely:

upper circular half (1*a*), centralized internally and externally threaded screw (1*a*1), internally threaded stretched portion (1*a*2), elongated wall (1*a*3), lower circular half (1*b*), central orifice (1*b*1) for passage of the central screw of the suction cap (1*c*), opposition circle (1*b*2) located below the lower circular half (1*b*) and that gives the suction cup (1*c*) its necessary conic suction shape to exert the function of fixing by adherence of the whole "dispensing system for hollow round packages" over a horizontal or vertical solid surface (10), suction cap (1*c*), centralized threaded pin (1*c*1) of the suction cap (1*c*), central piston (1*d*), optional upper sealant-disk (1*d*1), socket for attaching an optional upper sealant-disk (1*d*11), lower internally central socket (1*d*2), auxiliary threaded tube member (1*e*), inner threading lines (1*e*1), outer threading lines (1*e*2), FIG. 6B shows up the whole individual parts of the round supporting base (1) already assembled and adjusted, becoming ready to be fixed in a permanent horizontal or vertical solid surface (10) such as, for instance, the bathroom's walls or sink' surface by means of the suction cup (1*c*) whenever its circumference's edge (1*c*2) is touching and being pressed against an opposition circle (1*b*2) that will give the suction cup (1*c*) its necessary conic suction shape to keep the "dispensing system for hollow round packages" firmly steady, as disclosed through FIG. 6C, helping therefore all its users, including kids, elder and people with any physical limitation to be able to cope alone with their daily specific needs.

Figure 6C:
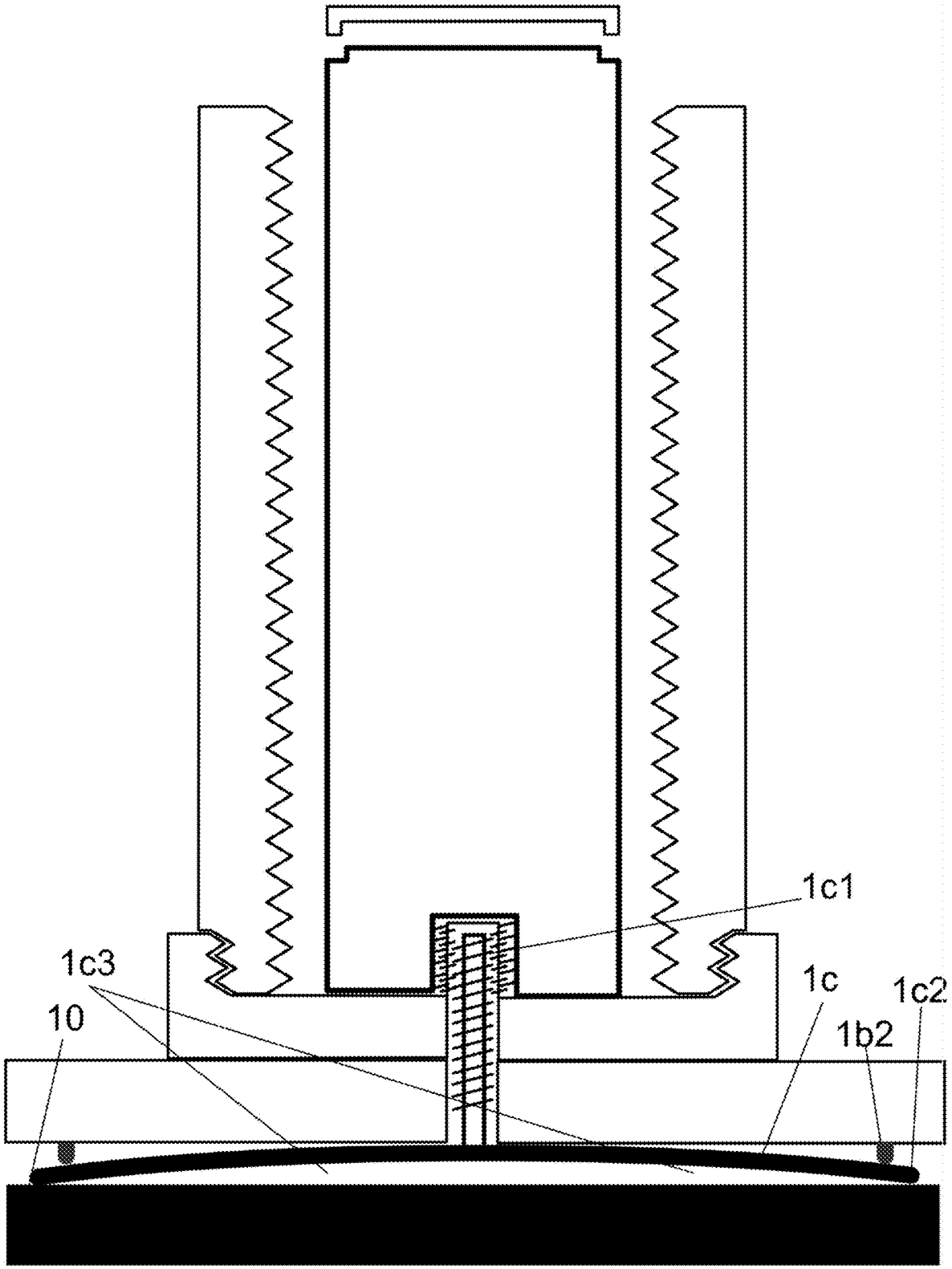

As disclosed through FIG. 6C, the process that allows the suction cup (1*c*) to acquire its necessary conic shape starts when its centralized threaded pin (1*c*1) trespasses the central orifice (1*b*1) existing at the center of the lower circular half (1*b*) so that it can be then progressively screwed at the internally threaded socket existing at the centralized screw (1*a*1), up to a point when the conic suction shape (1*c*3) is good enough to keep the whole "dispensing system for hollow round packages" firmly adhered to the desired place, such as a horizontal or vertical solid surface (10), as complementarily exhibited through FIGS. 7A and 7B, and 8A and 8B where it is also depicted the extraction of the product stored (2*e*) inside the round package (2) through the nozzle (5*b*), after the removal of its lid (5).

Through FIGS. 9A, 9B1 till 9B3 and 9C1 till 9C3, the assembling sequence for getting an alternative model of "dispensing system for hollow round packages" is disclosed in perspective view, in which the extraction of the stored content is done through the direct application of user's muscle strength over an adapted round package (RP-4), against the piston located at the round supporting base.

Thus, FIG. 9A discloses an adapted round package (RP-4) already fitted with external threads (7*a*) located at its upper end (7*b*), a flat opposite end (7*c*) and some exhaustion holes (7*d*) close to its lower end.

Through FIGS. 9B1 till 9B3 it can be seen the four individual parts that form the compatible supporting base (8) of the whole system, as follows:

Part 1—an upper circular half (8*a*) fitted with a centralized internally and externally threaded screw (8*a*1).

Part 2—a lower circular half (8*b*), fitted with a central orifice (8*b*1) aimed to accommodate a centralized threaded pin (8*c*1) existing at the suction cup (8*c*).

Part 3—a suction cup (8*c*) fitted with a centralized threaded pin (8*c*1) embodied into the compatible supporting base (8) to play the important role of keeping the whole device firmly attached to a flat surface either vertically or horizontally, so that it can be comfortable used by kids, elder and disabled people.

Part 4—a central piston (8*d*) having at its lower end an internally threaded socket (8*d*1) aimed to allow the attachment therein of the centralized screw (8*a*1) located at the center of the of the upper circular half (8*a*).

On FIG. 9B2 it is firstly disclosed that the lower circular half (8*b*) has been positioned over the suction cup (8*c*) whose centralized threaded pin (8*c*1) has already trespassed the central orifice (8*b*1) located at the lower circular half (8*b*), becoming ready to be internally threaded into the internally and externally threaded screw (8*a*1) located at the upper circular half (8*a*) aiming to create, when needed, a suction effect at the suction cup (8*c*), being this preliminary assembling phase completed, as disclosed by FIG. 9B2, in which the central piston (8*d*) is being connected to the compatible supporting base (8) where it will be screwed by means of its internally and externally threaded socket (8*d*1), as exhibited by FIG. 9B3.

On FIG. 9C1 it is disclosed how an adapted round package (RP-4), still unfitted with the round maneuverable closing cap (5) but fully loaded with the desired pasty goods (2*e*), is already positioned over a fully assembled, compatible supporting base (8).

On FIG. 9C2 it can be noted that an adapted round package (RP-4) has already received a round maneuverable closing cap (5) fitted with a lid (5*a*) which, in this example, has already been detached to expose its nozzle (5*b*), aiming to allow the extraction of the pasty product loaded to the adapted round package (RP-4) when it is being pressed downwards by users against the central piston (8*d*), causing therefore the expelling of the stored content through the lid (5*a*), as depicted by FIG. 9C3.

In order to facilitate users' procedures for extracting the content stored inside the adapted round package (RP-4) through the direct application of their muscle strength over said round package (RP-4) towards the piston located inside the round supporting base, it has been incorporated to the set an alternative guiding tube (9) fully flat inside and only fitted with few external threading (9*a*) at its bottom end (9*b*) in order to permit its fixture into an also alternative threading groove, not shown in the FIGS. 9C3, which is to be located on top surface of the upper circular half (8*a*), as depicted through the same FIG. 9C3.

The invention claimed is:

1. A dispensing system for hollow round packages formed by three self-complementary parts, wherein the hollow round packages are built with ecological materials and having external portions of threads at one or both ends;

The three self-complementary parts comprising:

the first part formed by a round supporting base for the dispensing system for the hollow round packages including:

an upper circular half comprising:

an internally and externally centralized threaded screw member and an internally threaded wall;

a lower circular half comprising:

a central orifice and a round wall opposing a round suction cup located below and close to an edge of the lower circular half;

the round suction cup comprising:

a flat round body entirely made up of elastic materials, capable to steadily retain an applied suction;

a threadable pin positioned at the center of said flat round body;

a central piston comprising: an upper sealing disc made up from resilient materials which is to be threaded to a centralized socket existing at a top end of the central piston by means of a screw located underneath and in a center of the upper sealing disc;

a guiding tubular member fitted with portions of external threading lines at a bottom end, and along the internal walls of said guiding tubular member;

the second part comprising:

a threadable and reusable round closing cap fitted with a nozzle though which the stored content at the hollow round packages will flow when pressed by users; and having internal threading portions fully compatible with the external threading existing at the top end of the hollow round packages where they will be manually attached by users, the third part comprising:

removing an empty hollow round package and replacing the hollow round packages, connecting the hollow round packages into the dispensing system at the one end, and attaching the threadable and reusable round closing cap fitted with the nozzle at the other end.

2. The dispensing system for hollow round packages, as in claim 1, wherein the round suction cup is screwed at a bottom of the round supporting base of the dispensing system for the hollow round packages.

3. The dispensing system for hollow round packages, as in claim 1, wherein threadable hollow packages are obtained by press-fitting screwable sleeves to one or both flat ends of a hollow tube segment.

4. Dispensing system for hollow round packages according to claim 1, wherein an extraction of a desired quantity of the selected pasty content is done by tightly fixing the dispensing system for hollow round packages in a vertical or horizontal stationary position by means of the round suction cup, while a manual rotation is applied through the hollow round package or through the guiding tubular member.

* * * * *